US011242724B2

(12) United States Patent
Young et al.

(10) Patent No.: US 11,242,724 B2
(45) Date of Patent: Feb. 8, 2022

(54) LAUNCHING OBJECTS INTO A WELLBORE

(71) Applicant: Downing Wellhead Equipment, LLC, Oklahoma City, OK (US)

(72) Inventors: Joel H. Young, Norman, OK (US); Ronnie B. Beason, Lexington, OK (US); Nicholas J. Cannon, Washington, OK (US)

(73) Assignee: DOWNING WELLHEAD EQUIPMENT, LLC, Oklahoma City, OK (US)

( * ) Notice: Subject to any disclaimer, the term of this patent is extended or adjusted under 35 U.S.C. 154(b) by 0 days.

(21) Appl. No.: 16/803,156

(22) Filed: Feb. 27, 2020

(65) Prior Publication Data

US 2020/0190934 A1 Jun. 18, 2020

Related U.S. Application Data

(63) Continuation-in-part of application No. 16/436,623, filed on Jun. 10, 2019, and a continuation-in-part of application No. 16/248,633, filed on Jan. 15, 2019, now Pat. No. 10,584,552, and a continuation-in-part of application No. 16/100,741, filed on Aug. 10, 2018, now Pat. No. 10,689,938.

(60) Provisional application No. 62/755,170, filed on Nov. 2, 2018, provisional application No. 62/638,688, filed on Mar. 5, 2018, provisional application No. 62/638,681, filed on Mar. 5, 2018, provisional application No. 62/637,220, filed on Mar. 1, 2018, provisional application No. 62/637,215, filed on Mar. 1, 2018, provisional application No. 62/617,438, filed (Continued)

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS 2,953,157 A 9/1960 Osborne et al.
3,039,531 A * 6/1962 Scott ..... E21B 33/068 166/70

(Continued)

FOREIGN PATENT DOCUMENTS

CN 204163704 2/2015

OTHER PUBLICATIONS

International Search Report and Written Opinion received in Patent Cooperation Treaty Application No. PCT/US2019/013696, dated Apr. 3, 2019 12 pages.

*Primary Examiner* — Giovanna Wright
(74) *Attorney, Agent, or Firm* — Haynes and Boone, LLP

(57) ABSTRACT

Apparatus, systems, and methods according to which a launcher defines a central passageway and is adapted to launch an object into the central passageway so that the object enters an oil and gas wellbore. The launcher includes a cylinder rotatable about an axis between first and second angular positions, the cylinder defining a chamber into which the object is loadable when the cylinder is in the first angular position, and from which the loaded object is launchable when the cylinder is in the second angular position. A lubricator is extendable through, and retractable from, the central passageway of the launcher.

32 Claims, 34 Drawing Sheets

Related U.S. Application Data on Jan. 15, 2018, provisional application No. 62/598,914, filed on Dec. 14, 2017.

(56) References Cited

U.S. PATENT DOCUMENTS

| | | | | |
|---|---|---|---|---|
| 3,070,010 | A | | 12/1962 | Robinson, Jr. |
| 3,372,705 | A | * | 3/1968 | Bodhaine ..... E21B 33/068 137/268 |
| 4,785,880 | A | | 11/1988 | Ashton |
| 5,188,178 | A | | 2/1993 | Noyes |
| 6,039,122 | A | | 3/2000 | Gonzalez |
| 6,044,905 | A | | 4/2000 | Harrison, III |
| 6,182,765 | B1 | | 2/2001 | Kilgore |
| 6,269,875 | B1 | | 8/2001 | Harrison, III et al. |
| 6,533,032 | B1 | | 3/2003 | Seixas et al. |
| 6,637,512 | B2 | | 10/2003 | Casey |
| 7,571,773 | B1 | | 8/2009 | West et al. |
| 10,287,844 | B2 | | 5/2019 | Johnson |
| 2003/0192690 | A1 | | 10/2003 | Carlson et al. |
| 2008/0053650 | A1 | | 3/2008 | Hovelkamp et al. |
| 2008/0223587 | A1 | | 9/2008 | Cherewyk |
| 2015/0114626 | A1 | | 4/2015 | Hatten et al. |
| 2017/0022777 | A1 | | 1/2017 | Allen et al. |

* cited by examiner

LAUNCHING OBJECTS INTO A WELLBORE

CROSS-REFERENCE TO RELATED APPLICATIONS

This application is a continuation-in-part (CIP) of U.S. patent application Ser. No. 16/248,633 (the "'633 Application"), filed Jan. 15, 2019, the entire disclosure of which is hereby incorporated herein by reference. The '633 Application claims the benefit of the filing date of, and priority to, U.S. patent application Ser. No. 62/617,438, filed Jan. 15, 2018, the entire disclosure of which is hereby incorporated herein by reference.

This application is also a CIP of U.S. patent application Ser. No. 16/436,623 (the "'623 Application"), filed Jun. 10, 2019, the entire disclosure of which is hereby incorporated herein by reference. The '623 Application claims the benefit of the filing date of, and priority to, U.S. patent application Ser. No. 62/755,170, filed Nov. 2, 2018, the entire disclosure of which is hereby incorporated herein by reference.

This application is also a CIP of U.S. patent application Ser. No. 16/100,741 (the "'741 Application"), filed Aug. 10, 2018, the entire disclosure of which is hereby incorporated herein by reference. The '741 Application claims the benefit of the filing date of, and priority to, U.S. Patent Application No. 62/638,688, filed Mar. 5, 2018, U.S. patent application Ser. No. 62/638,681, filed Mar. 5, 2018, U.S. patent application Ser. No. 62/637,220, filed Mar. 1, 2018, U.S. patent application Ser. No. 62/637,215, filed Mar. 1, 2018, and U.S. patent application Ser. No. 62/598,914, filed Dec. 14, 2017, the entire disclosures of which are hereby incorporated herein by reference.

This application is related to U.S. patent application Ser. No. 16/801,911, filed Feb. 26, 2020, the entire disclosure of which is hereby incorporated herein by reference.

BACKGROUND

The present disclosure related generally to oil and gas operations and, more particularly, to launching objects into a wellbore.

BRIEF DESCRIPTION OF THE DRAWINGS

FIG. 3C-1 is an exploded top perspective view of FIG. 3A's kicker device including the first housing and a kicker, according to one or more embodiments.

FIG. 3C-2 is an exploded top perspective view of FIG. 3C-1's kicker, according to one or more embodiments.

FIG. 3E-1 is an exploded top perspective view of FIG. 3D's kicker device including the first housing, the kicker, the feeder, and a follower, according to one or more embodiments.

FIG. 3E-2 is an exploded top perspective view of FIG. 3E-1's follower, according to one or more embodiments.

FIG. 6A-1 is a top plan view of FIG. 2's launcher in a first operational state or configuration, according to one or more embodiments.

FIG. 6A-2 is a cross-section of FIG. 6A-1's launcher in the first operational state or configuration taken along the line 6A-2-6A-2 of FIG. 6A-1, according to one or more embodiments.

FIG. 6A-3 is a top perspective view of FIG. 6A-1's launcher in the first operational state or configuration, according to one or more embodiments.

FIG. 6B-1 is a top plan view of FIG. 2's launcher in a second operational state or configuration, according to one or more embodiments.

FIG. 6B-2 is a cross-section of FIG. 6B-1's launcher in the second operational state or configuration taken along the line 6B-2-6B-2 of FIG. 6B-1, according to one or more embodiments.

FIG. 6B-3 is a top perspective view of FIG. 6B-1's launcher in the second operational state or configuration, according to one or more embodiments.

FIG. 6C-1 is a top plan view of FIG. 2's launcher in a third operational state or configuration, according to one or more embodiments.

FIG. 6C-2 is a cross-section of FIG. 6C-1's launcher in the third operational state or configuration taken along the line 6C-2-6C-2 of FIG. 6C-1, according to one or more embodiments.

FIG. 6C-3 is a top perspective view of FIG. 6C-1's launcher in the second operational state or configuration, according to one or more embodiments.

DETAILED DESCRIPTION

Figure 1:
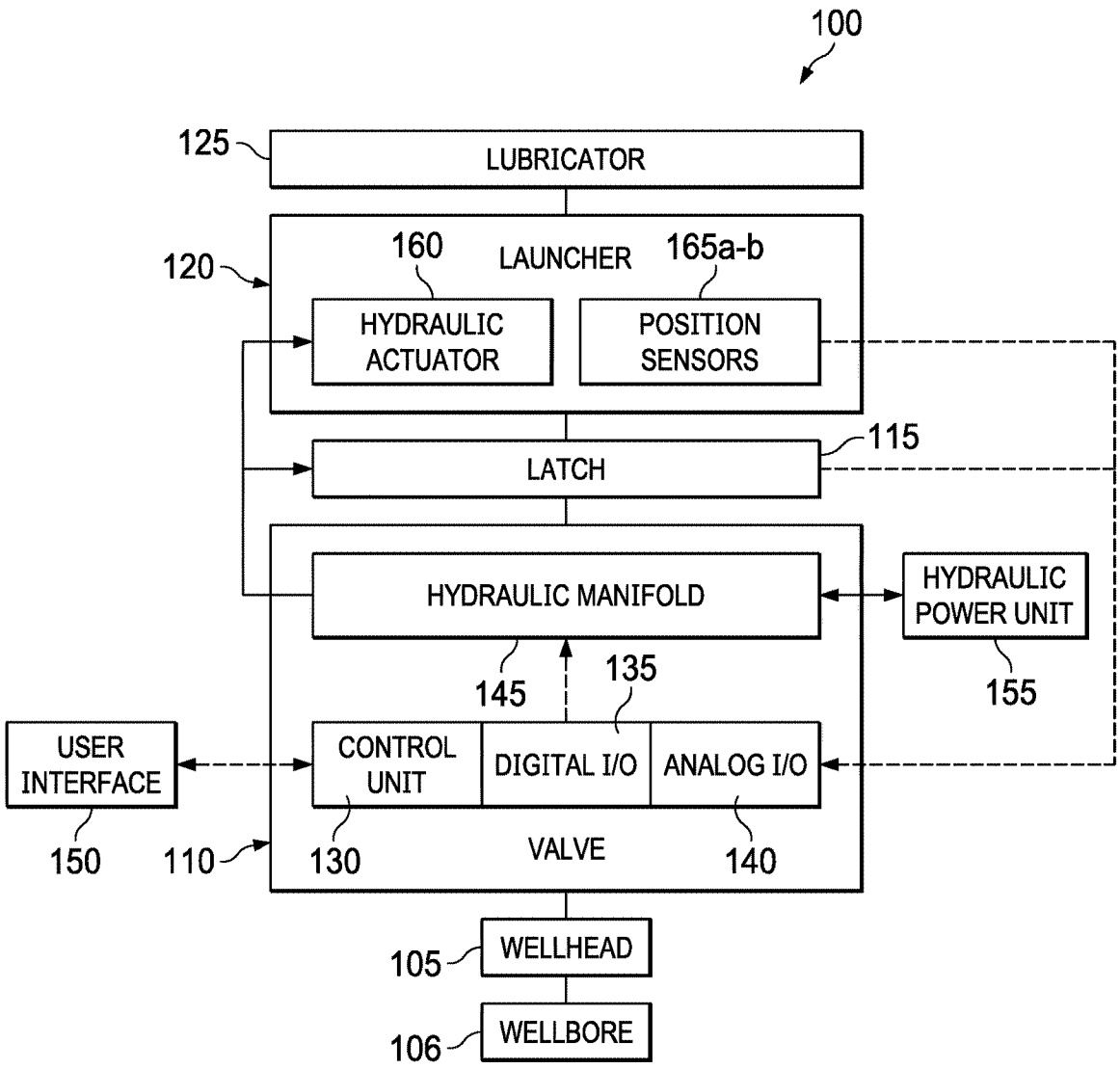
FIG. 1 is a diagrammatic illustration of a system such as, for example, a hydraulic fracturing system, according to one or more embodiments.

Referring to FIG. 1, in an embodiment, a system is generally referred to by the reference numeral 100 and includes a wellhead 105, a valve 110, a latch 115, a launcher 120, and a lubricator 125. The wellhead 105 is the surface termination of a wellbore 106 that traverses one or more subterranean formations. The valve 110 is operably coupled to the wellhead 105. In several embodiments, the valve 110 is, includes, or is part of the valve apparatus described in U.S. patent application Ser. No. 15/487,785 (the "'785 Application"), filed Apr. 14, 2017, and published Oct. 19, 2017 as U.S. Publication No. 2017/0298708, the entire disclosure of which is hereby incorporated herein by reference. The valve 110 includes a control unit 130, a digital input/output ("I/O") 135, an analog I/O 140, and a hydraulic manifold 145. A user interface 150 communicates signals to, and receives signals from, the control unit 130. A hydraulic power unit ("HPU") 155 keeps the hydraulic manifold 145 charged with hydraulic fluid by communicating hydraulic fluid to, and receiving hydraulic fluid from, the hydraulic manifold 145. The latch 115 is operably coupled to the valve 110, opposite the wellhead 105. The launcher 120 is operably coupled to the latch 115, opposite the valve 110. Although not shown in FIG. 1, in several embodiments, a blowout preventer (BOP) may be operably coupled to the launcher 120, opposite the latch 115.

The lubricator 125 is extendable through the launcher 120 (and the BOP attached thereto in certain embodiments) and, when so extended, attachable to the latch 115. More particularly, the control unit 130 communicates signals to the hydraulic manifold 145 via the digital I/O 135, which signals cause the hydraulic manifold 145 to communicate hydraulic fluid to, and/or receive hydraulic fluid from, the latch 115 to thereby operate the latch 115. Subsequently, the lubricator 125 is detachable from the latch 115 in a similar manner and, when so detached, retractable from the launcher 120. In several embodiments, the latch 115, the lubricator 125, and the process of attaching/detaching the lubricator 125 to/from the latch 115 are described in the '623 Application, the '741 Application, or a combination thereof.

The launcher 120 includes a hydraulic actuator 160 and position sensors 165*a-b*. The position sensors 165*a-b* detect the position(s) of one or more components of the launcher 120 and communicate signals to the control unit 130 via the analog I/O 140 based on the detected position(s), as will be described in further detail below. The control unit 130 communicates signals (e.g., based on the signals received from the position sensors 165*a-b*) to the hydraulic manifold 145 via the digital I/O 135, which signals cause the hydraulic manifold 145 to communicate hydraulic fluid to, and/or receive hydraulic fluid from the hydraulic actuator 160 to thereby operate the launcher 120, as will be described in further detail below. In several embodiments, the hydraulic actuator 160 is omitted and replaced with an electric or pneumatic actuator.

In several embodiments, the system 100 is, includes, or is part of a hydraulic fracturing system, which hydraulic fracturing system may be used to facilitate the recovery of oil and gas from the one or more subterranean formations traversed by the wellbore 106. For example, the system 100 may be adapted to perform a hydraulic fracturing operation on the wellbore 106. In such instances, the wellhead 105 is, includes, or is part of a "frac stack" to which the launcher 120 is operably coupled. The embodiments provided herein are not, however, limited to a hydraulic fracturing system, as the system 100 may be used with, or adapted to, a mud pump system, a well treatment system, one or more other pumping systems, one or more systems at the wellhead, one or more systems upstream of the wellhead, one or more systems downstream of the wellhead, and/or one or more other systems associated with the wellhead.

Figure 2:
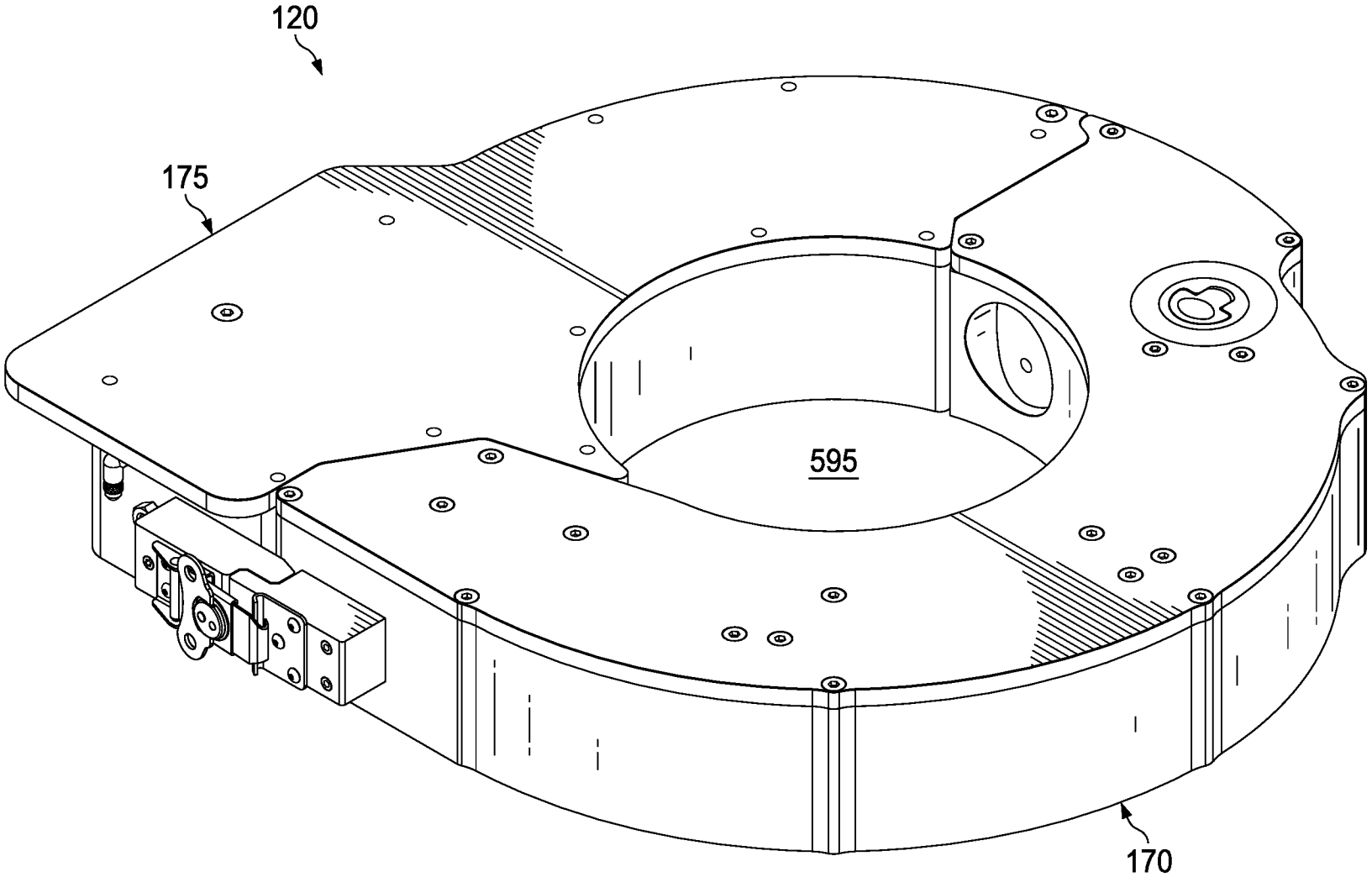
FIG. 2 is a top perspective view of a launcher of FIG. 1's system, according to one or more embodiments.

Referring to FIG. 2, with continuing reference to FIG. 1, in an embodiment, the launcher 120 includes a kicker device 170 and an actuator device 175. The kicker device 170 is adapted to launch an object (e.g., a ball) into the wellbore 106, as will be described in further detail below. The actuator device 175 is adapted to actuate the kicker device 170, as will be described in further detail below.

Figure 3A:
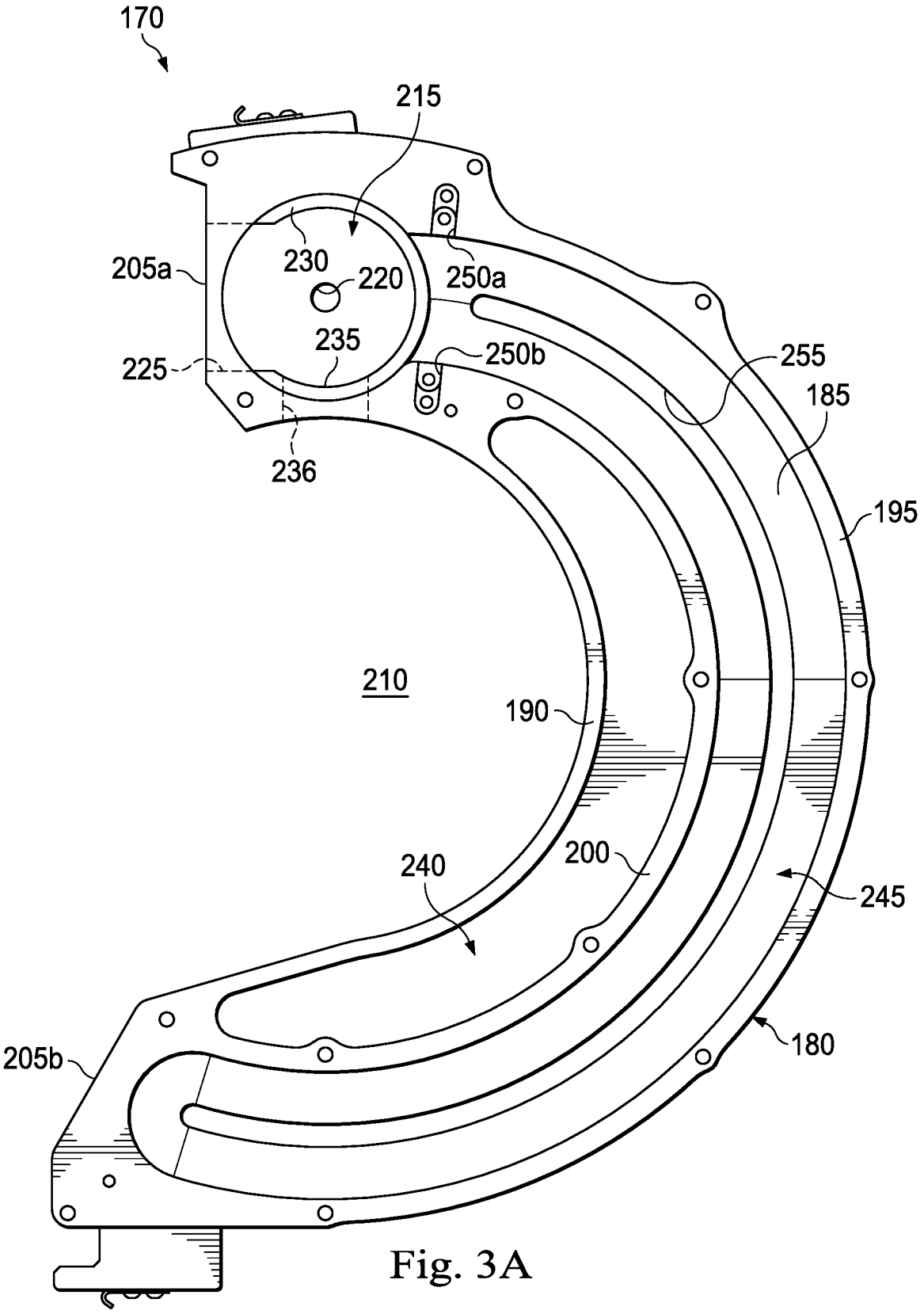
FIG. 3A is a top plan view of a first housing of a kicker device of FIG. 2's launcher, according to one or more embodiments.
Figure 3B:
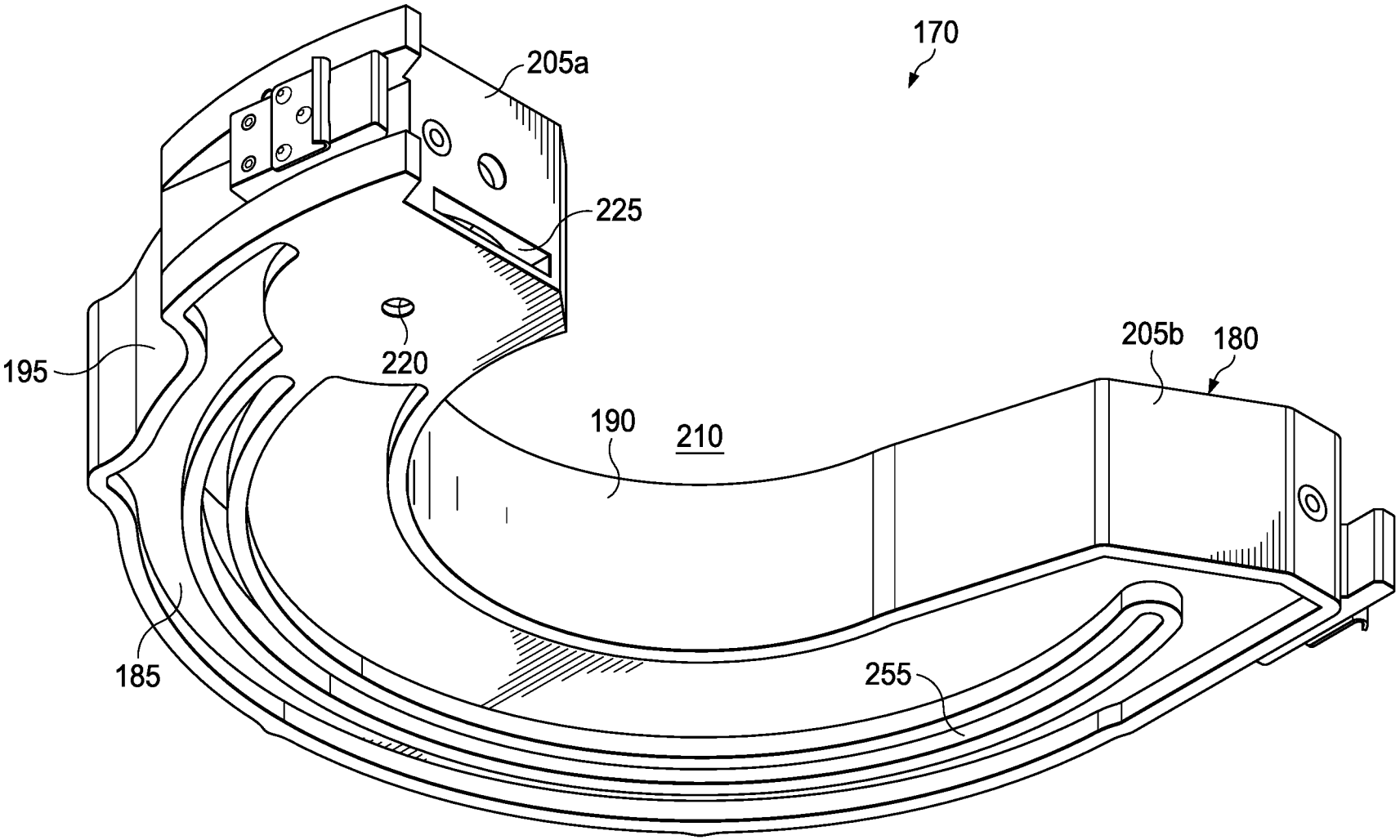
FIG. 3B is a bottom perspective view of FIG. 3A's first housing, according to one or more embodiments.

Referring to FIGS. 3A and 3B, with continuing reference to FIG. 2, in an embodiment, the kicker device 170 includes a housing 180, which housing 180 includes a deck plate 185, an inner wall 190, an outer wall 195, an intermediate wall 200, and end walls 205*a-b*. The inner wall 190, the outer wall 195, the intermediate wall 200, and the end walls 205*a-b* extend transversely from the deck plate 185. The inner wall 190 defines an exterior recess 210 in the housing 180. The end wall 205*a* is connected to the inner wall 190, and the end wall 205*b* is also connected to the inner wall 190, opposite the end wall 205*a*. The outer wall 195 is connected to the end walls 205*a-b*, opposite the inner wall 190. A kicker receptacle 215 is defined in the housing 180 proximate the end wall 205*a* and between the inner wall 190 and the outer wall 195; for example, the inner wall 190, the deck plate 185, the end wall 205*a*, and the outer wall 195, in combination, may define the kicker receptacle 215. A bearing hole 220 is formed transversely through the deck plate 185 from the kicker receptacle 215. Moreover, a gear hole 225 is formed transversely through the end wall 205*a* from the kicker receptacle 215. A shoulder 230 extends proximate the deck plate 185 along a periphery of the kicker receptacle 215, and a surface 235 extends from the shoulder 230 to the deck plate 185; for example, the shoulder 230 and the surface 235 may be truncated so as not to obstruct the gear hole 225. Finally, an opening 236 is formed transversely through the inner wall 190 from the kicker receptacle 215, above the shoulder 230.

The intermediate wall 200 extends between the inner wall 190 and the outer wall 195. A hollow cavity 240 is defined in the housing 180 between the inner wall 190 and the intermediate wall 200, opposite the exterior recess 210; for example, the inner wall 190, the deck plate 185, and the intermediate wall 200, in combination, may define the hollow cavity 240. A magazine cavity 245 is also defined in the housing 180 between the intermediate wall 200 and the outer wall 195, opposite the hollow cavity 240; for example, the intermediate wall 200, the deck plate 185, the end wall 205*b*, and the outer wall 195, in combination, may define the magazine cavity 245. The magazine cavity 245 extends arcuately from the kicker receptacle 215, opposite the gear hole 225, to the end wall 205*b*. Feeder receptacles 250*a-b* are formed in the housing 180 on opposing sides of the magazine cavity 245, proximate the kicker receptacle 215; for example, the feeder receptacles 250*a-b* may be formed transversely into the intermediate wall 200 and the outer wall 195, respectively. Finally, a guide groove 255 is formed in the housing 180 transversely through the deck plate 185 from the magazine cavity 245; for example, the guide groove 255 may extend along the magazine cavity 245 between the intermediate wall 200 and the outer wall 195. The guide groove 255 extends arcuately from a location proximate the kicker receptacle 215 to a location proximate the end wall 205*b*.

Figures 1, 3C:
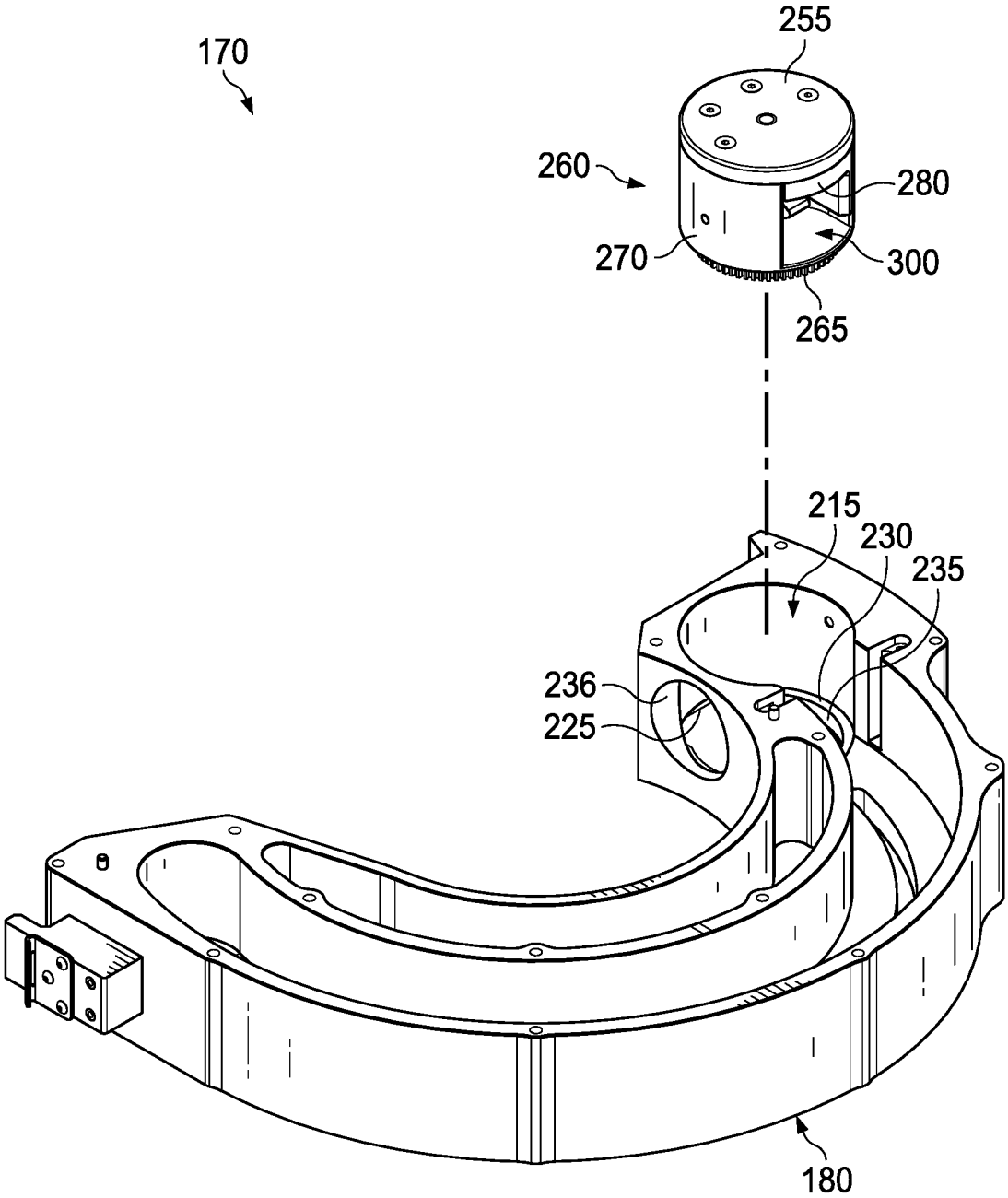
Figures 2, 3C:
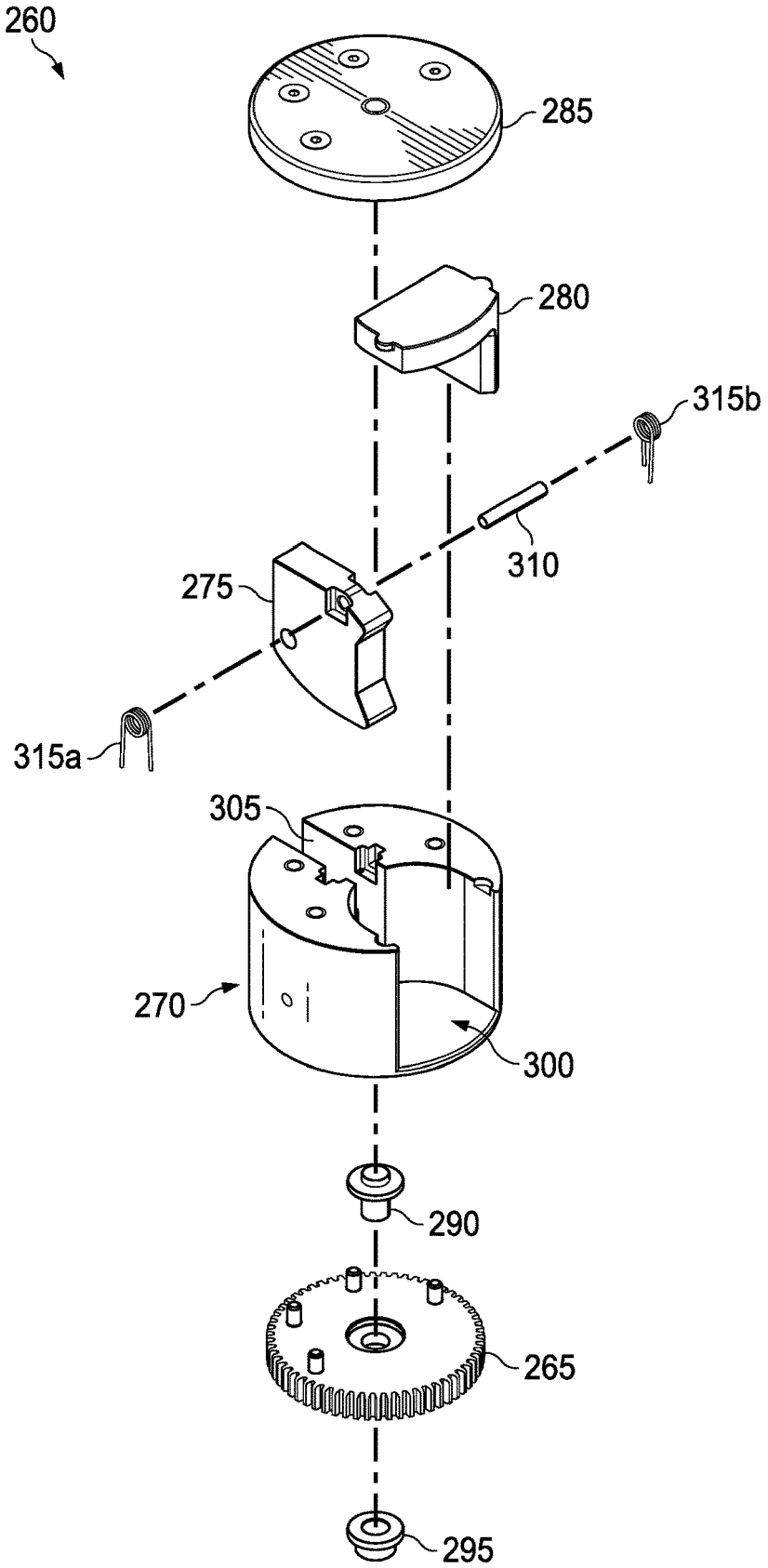

Referring to FIGS. 3C-1 and 3C-2, with continuing reference to FIGS. 3A and 3B, in an embodiment, the kicker device 170 includes a kicker 260. The kicker device 170 is shown in an exploded state in FIG. 3C-1 to illustrate the manner in which kicker 260 is received within the kicker receptacle 215 of the housing 180, and the kicker 260 is shown in an exploded state in FIG. 3C-2 to illustrate the various features and components of the kicker 260; however, in connection with FIGS. 3C-1 and 3C-2, the kicker device 170 and the kicker 260 are described below in their non-exploded states. In this regard, the kicker 260 extends within the kicker receptacle 215 of the housing 180 and includes a gear 265, a cylinder 270, a foot 275, a shim 280, and a cover plate 285. The gear 265 is fastened to the cylinder 270. The surface 235 of the housing 180 is profiled to receive the gear 265. The cylinder 270 overlaps the shoulder 230. A shaft 290 extends through the gear 265 and into a bearing 295 mounted in the bearing hole 220 of the housing 180. The cylinder 270 includes a chamber 300 and a foot receptacle 305. A shaft 310 supports the foot 275 within the foot receptacle 305, and springs 315*a-b* carried on the shaft 310 bias the foot 275 into the chamber 300. In several embodiments, the springs 315*a-b* are omitted and replaced with an electric, hydraulic, or pneumatic actuator adapted to move the foot 275 in and out of the chamber 300. Finally, the cover plate 285 is fastened to the cylinder 270, opposite the gear 265, to secure the shim 280 within the chamber 300. In this position, the shim 280 is adapted to guide objects (e.g., balls) into the chamber 300 while preventing jamming of the objects within the chamber 300 and/or the magazine cavity 245, as will be described in further detail below.

Figure 3D:
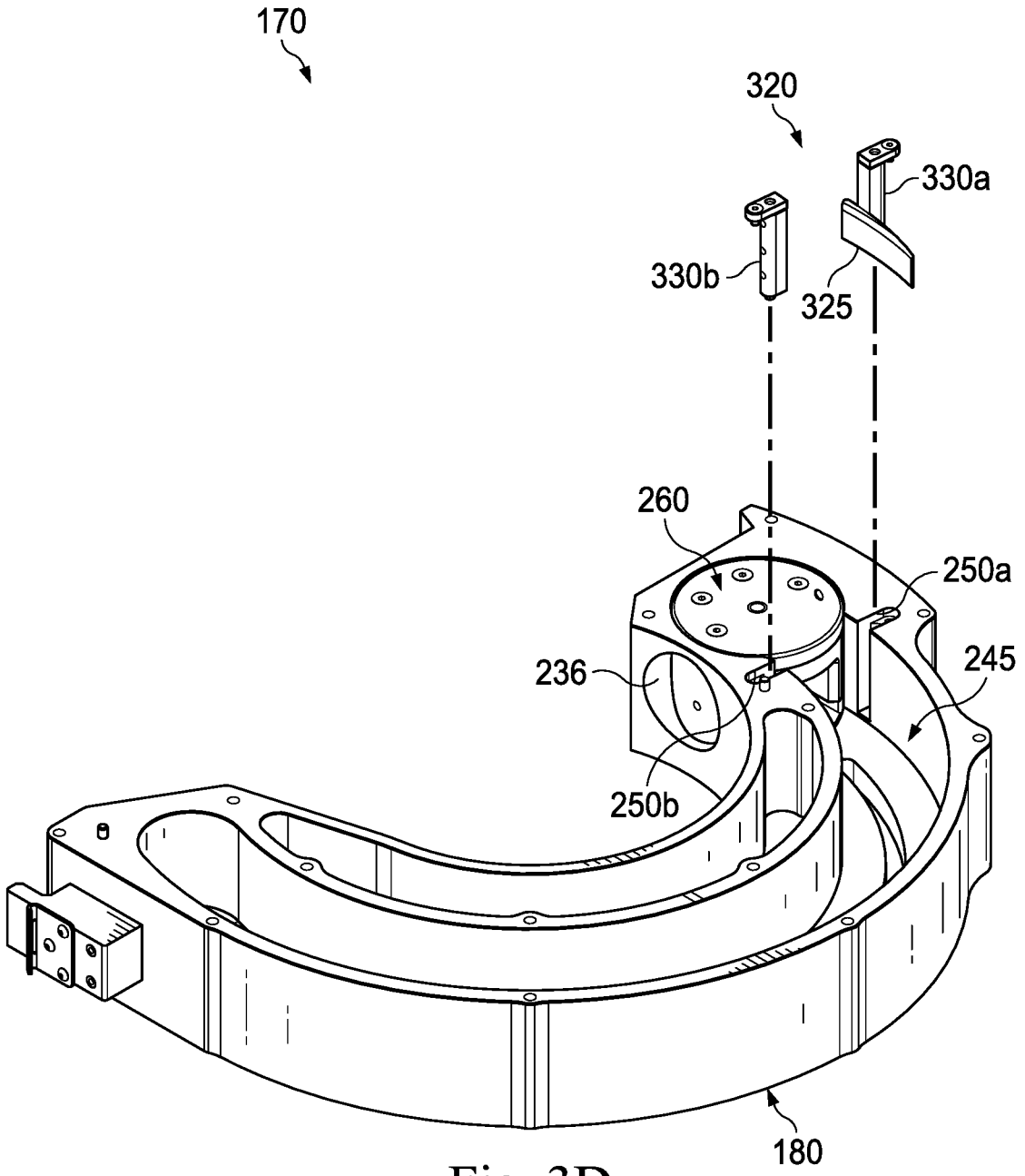
FIG. 3D is an exploded top perspective view of FIG. 3C-1's kicker device including the first housing, the kicker, and a feeder, according to one or more embodiments.

Referring to FIG. 3D, with continuing reference to FIGS. 3A through 3C-2, in an embodiment, the kicker device 170 further includes a feeder 320. The kicker device 170 is shown in an exploded state in FIG. 3D to illustrate the manner in which the feeder receptacles 250*a-b* of the housing 180 receive the feeder 320; however, in connection with FIG. 3D, the kicker device 170 is described below in its non-exploded state. In this regard, the feeder 320 extends within the feeder receptacles 250*a-b* of the housing 180 and includes a shim 325 and support members 330*a-b*. More particularly, the support members 330*a-b* extend within the feeder receptacles 250*a-b*, respectively, and are fastened to the housing 180. The shim 325 extends from the support member 330*a* into the magazine cavity 245, adjacent the kicker 260. In this position, the shim 325 is adapted to guide objects (e.g., balls) into the chamber 300 while preventing jamming of the objects within the chamber 300 and/or the magazine cavity 245, as will be described in further detail below.

Figures 1, 3E:
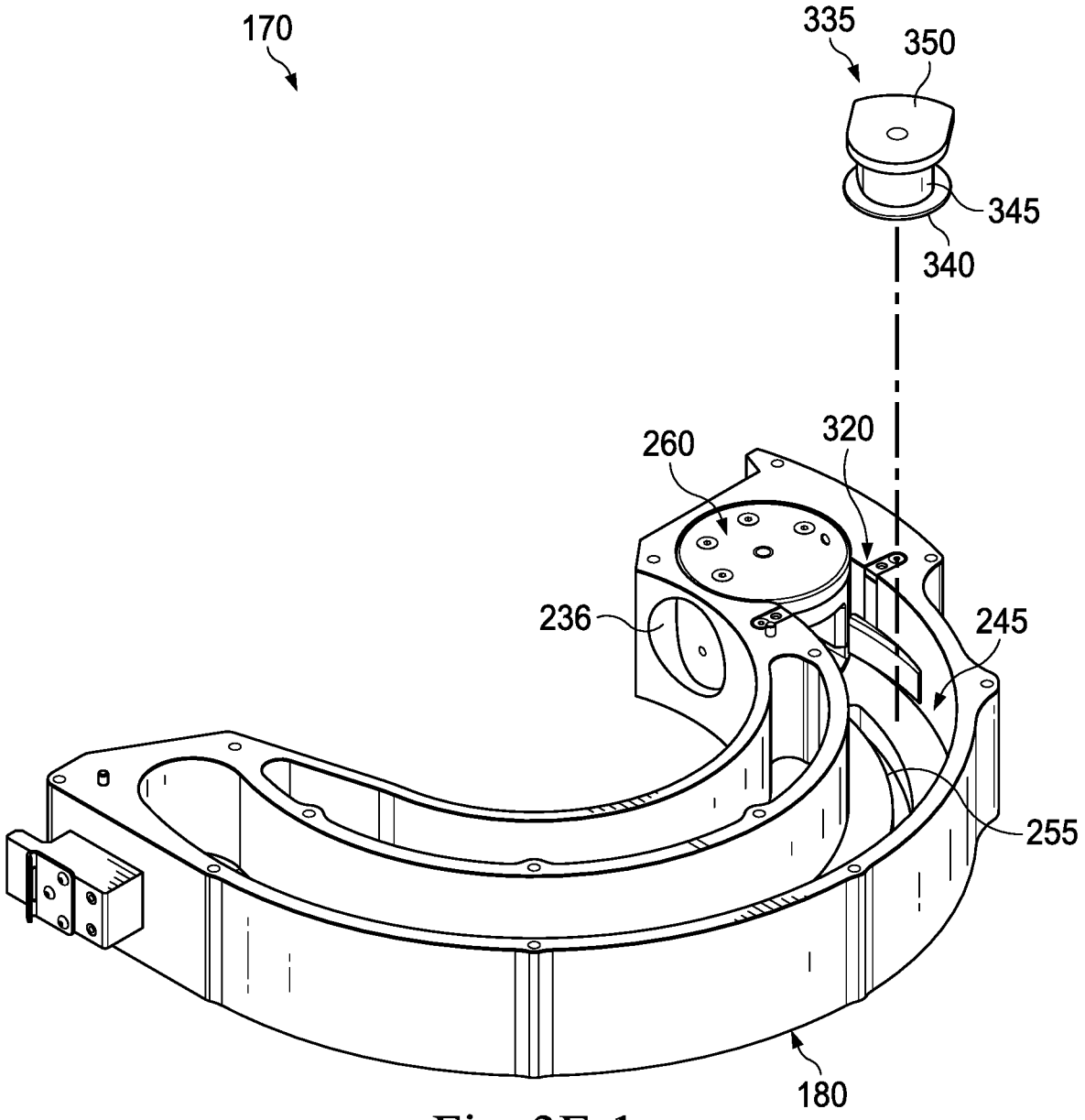
Figures 2, 3E:
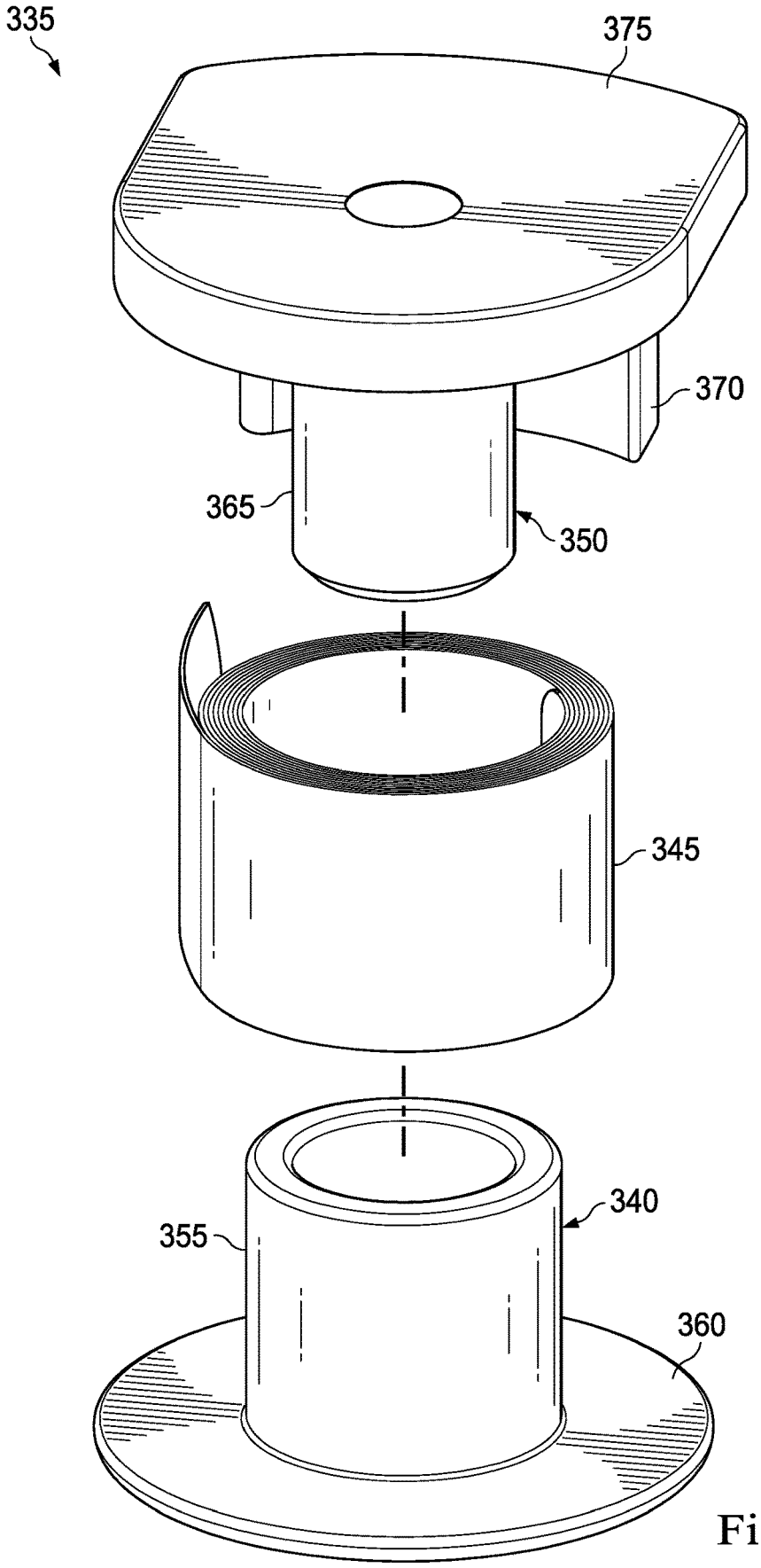

Referring to FIGS. 3E-1 and 3E-2, with continuing reference to FIGS. 3A through 3D, in an embodiment, the kicker device 170 further includes a follower 335. The kicker device 170 is shown in an exploded state in FIG. 3E-1 to illustrate the manner in which the magazine cavity 245 of the housing 180 receives the follower 335, and the follower 335 is shown in an exploded state in FIG. 3E-2 to illustrate the various features and components of the follower 335; however, in connection with FIGS. 3E-1 and 3E-2, the kicker device 170 and the follower 335 are described below in their non-exploded states. In this regard, the follower 335 extends within the magazine cavity 245 of the housing 180 and includes a spool 340, a spring 345, and a pusher 350. The spool 340 includes a hollow shaft 355 extending transversely from a flange 360. The spring 345 is a spiral torsion spring. The pusher 350 includes a shaft 365, a wall 370, and a plate 375. The shaft 365 and the wall 370 are spaced apart from each other and extend transversely from the plate 375. The hollow shaft 355 of the spool 340 receives the shaft 365 of the pusher 350. The spring 345 is positioned between the hollow shaft 355 of the spool 340 and the wall 370 of the pusher 350. The spring 345 is adapted to bias the follower 335 towards the kicker receptacle 215. More particularly, the spring 345 is coiled around the pusher 350, and an end of the spring 345 is fixed to the housing 180 near the kicker receptacle 215. As the follower 335 is moved away from the kicker receptacle 215 (e.g., by the loading of objects into the magazine cavity 245), the spring 345 uncoils from the pusher 350 (e.g., along the intermediate wall 200 of the housing 180). As a result, the spring 345 exerts a biasing force on the follower 335 to return the follower 335 towards its starting point near the kicker receptacle 215. Objects loaded in the magazine cavity 245 between the follower 335 and the kicker receptacle 215 are thus urged towards the magazine cavity 245 by the spring 345.

Figure 3F:
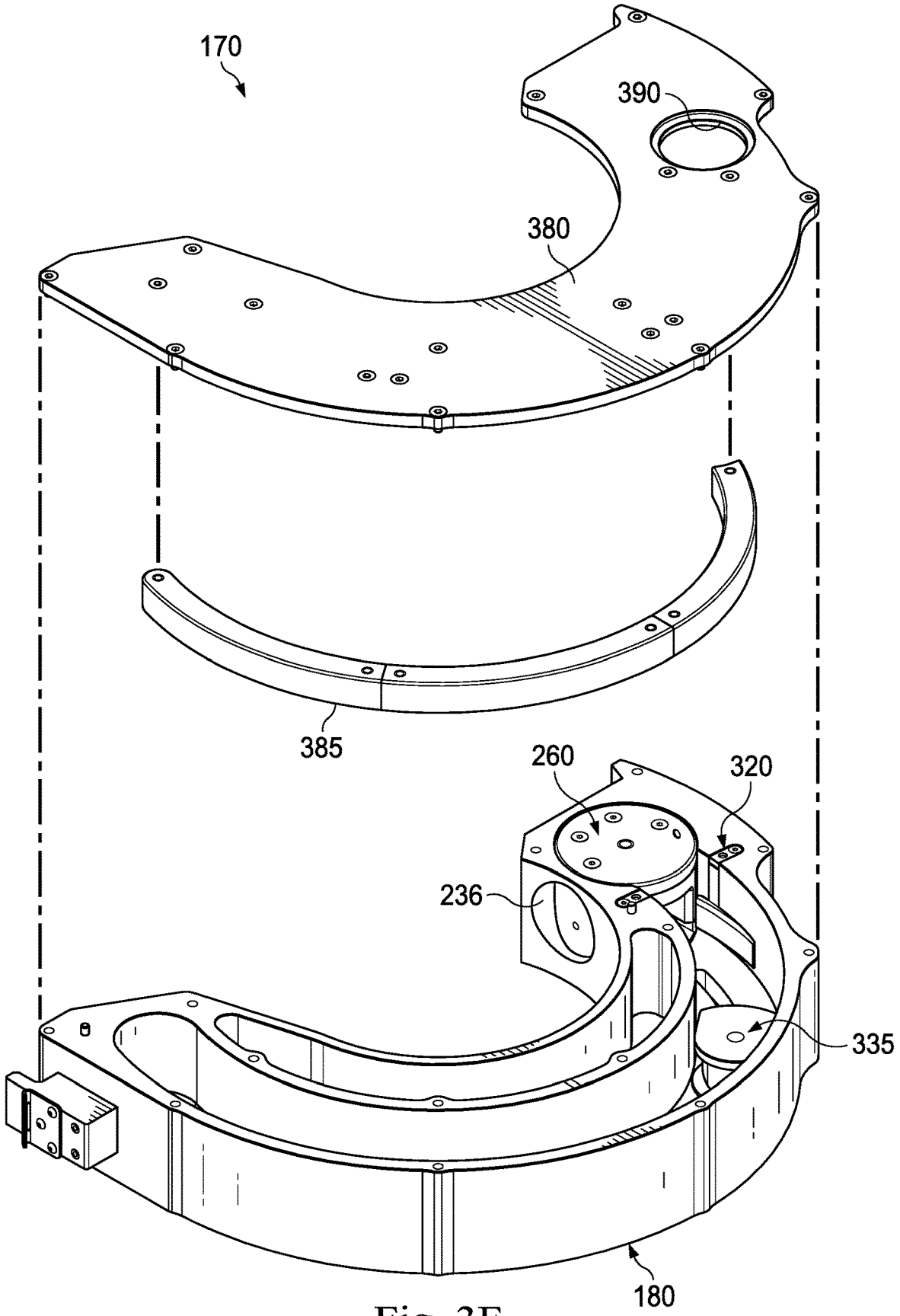
FIG. 3F is an exploded top perspective view of FIG. 3E-1's kicker device including the first housing, the kicker, the feeder, the follower, and a first cover plate, according to one or more embodiments.

Referring to FIG. 3F, with continuing reference to FIGS. 3A through 3E-2, in an embodiment, the kicker device 170 further includes a cover plate 380. The kicker device 170 is shown in an exploded state in FIG. 3F to illustrate the manner in which the cover plate 380 is fastened to the housing 180; however, in connection with FIG. 3F, the kicker device 170 is described below in its non-exploded state. In this regard, the cover plate 380 is fastened to the housing 180 to contain the kicker 260, the feeder 320, and the follower 335 within the housing 180. A shim 385 is fastened to the cover plate 380 and extends within the magazine cavity 245. In this position, the shim 385 is adapted to guide objects (e.g., balls) into the chamber 300 while preventing jamming of the objects within the chamber 300 and/or the magazine cavity 245, as will be described in further detail below. The cover plate 380 includes an opening 390 formed transversely therethrough to permit access into the magazine cavity 245 proximate the kicker 260.

Figure 3G:
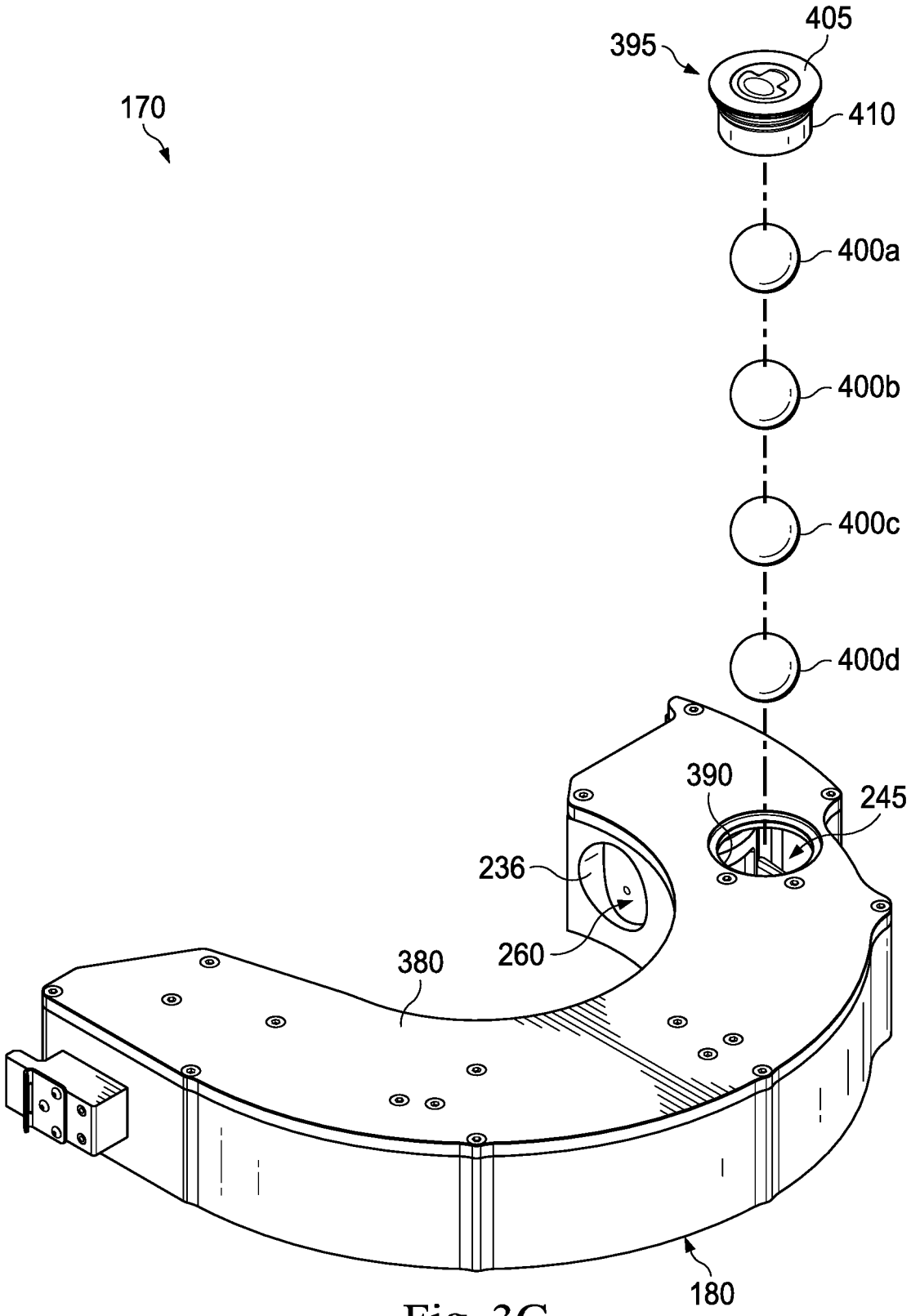
FIG. 3G is an exploded top perspective view of FIG. 3F's kicker device including the first housing, the kicker, the feeder, the follower, the first cover plate, a lid, and a plurality of balls, according to one or more embodiments.

Referring to FIG. 3G, with continuing reference to FIGS. 3A through 3F, in an embodiment, the kicker device 170 further includes a lid 395. The kicker device 170 is shown in an exploded state in FIG. 3G to illustrate the manner in which the lid 395 is secured within the opening 390 of the cover plate 380; however, in connection with FIG. 3G, the kicker device 170 is described below in its non-exploded state. In this regard, balls 400*a-d* are loaded into the magazine cavity 245 via the opening 390. During such loading, the follower 335 is displaced along the guide groove 255 and potential energy is imparted to the spring 345 so that the balls 400*a-d* are biased toward the kicker 260. The lid 395 is secured within the opening 390 of the cover plate 380 to contain the balls 400*a-d* within the magazine cavity 245; for example, the lid 395 may include a latching cover plate 405 and a shim 410 that extends into the magazine cavity 245. In this position, the shim 410 is adapted to guide objects (e.g., balls) into the chamber 300 while preventing jamming of the objects within the chamber 300 and/or the magazine cavity 245, as will be described in further detail below. Although shown herein with only four (4) balls 400*a-d*, a lesser or greater number of balls may be loaded into the launcher 120. In addition, or instead, balls or other objects of varying shapes (e.g., cylindrical) may be loaded into the launcher 120. The shims 280, 325, 385, and 410 may be switched out for differently-sized shims (e.g., thinner or thicker) to accommodate the different sized balls or other objects. In addition to, or instead of, the shims 280, 325, 385, and 410, the launcher 120 may include flexible guide rails biased to accommodate the different sized balls or other objects. Such flexible guide rails facilitate the use of ascending- or descending-sized balls (or other objects) without the need to change out shims.

Figure 4A:
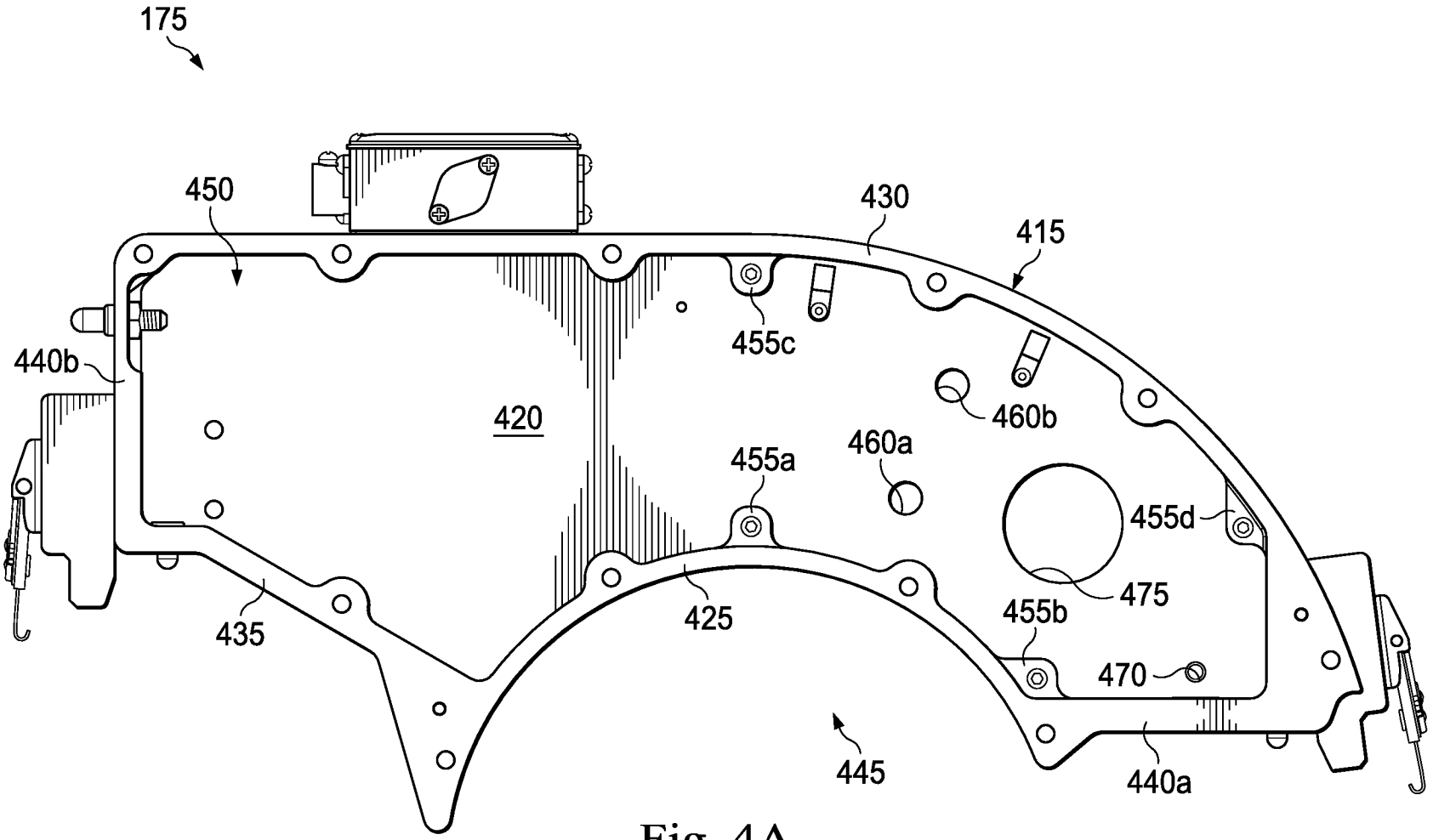
FIG. 4A is a top plan view of a second housing of an actuator device of FIG. 2's launcher, according to one or more embodiments.

Referring to FIG. 4A, with continuing reference to FIG. 2, in an embodiment, the actuator device 175 includes a housing 415, which housing 415 includes a deck plate 420, an inner wall 425, an outer wall 430, an intermediate wall 435, and end walls 440*a-b*. The inner wall 425, the outer wall 430, the intermediate wall 435, and the end walls 440*a-b* extend transversely from the deck plate 420. The inner wall 425 defines an exterior recess 445 in the housing 415. The end wall 440*a* is connected to the inner wall 425. The intermediate wall 435 is also connected to the inner wall 425, opposite the end wall 440*a*. The end wall 440*b* is connected to the intermediate wall 435 opposite the inner wall 425. The outer wall 430 is connected to the end walls 440*a-b*, opposite the inner wall 425 and the intermediate wall 435. An internal cavity 450 is defined between the inner wall 425 and the outer wall 430, opposite the exterior recess 445; for example, the inner wall 425, the deck plate 420, the intermediate wall 435, the end walls 440*a-b*, and the outer wall 430, in combination, may define the internal cavity 450. Bearing plate supports 455*a-d* are formed on opposing sides of the internal cavity 450; for example, the bearing plate supports 455*a-b* may extend transversely from the deck plate 420 adjacent the inner wall 425, and the bearing plate supports 455*c-d* may extend transversely from the deck plate 420 adjacent the outer wall 430. Bearing holes 460*a-b* are formed transversely through the deck plate 420.

Figure 4B:
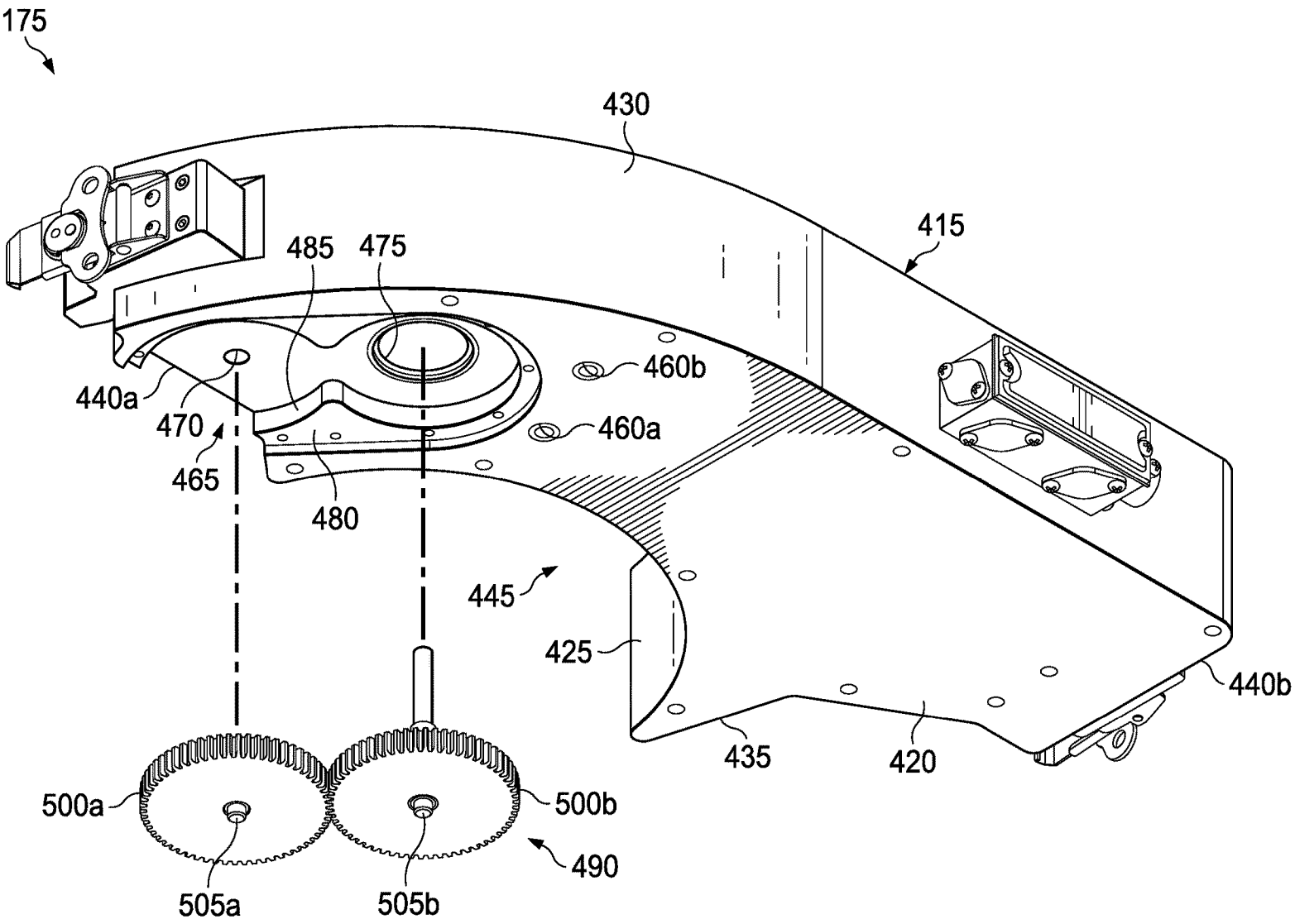
FIG. 4B is an exploded bottom perspective view of FIG. 4A's actuator device including the second housing and a gear set, according to one or more embodiments.

Referring to FIG. 4B, with continuing reference to FIG. 4A, in an embodiment, a gear receptacle 465 is formed into the deck plate 420, opposite the internal cavity 450 and proximate the bearing holes 460*a-b*. A bearing hole 470 and a gear hole 475 are formed transversely through the deck plate 420 from the gear receptacle 465. A shoulder 480 extends proximate the deck plate 420 along a periphery of the gear receptacle 465, and a surface 485 extends from the shoulder 480 to the deck plate 420.

Referring still to FIG. 4B, with continuing reference to FIG. 4A, in an embodiment, the actuator device 175 further includes a gear set 490. The actuator device 175 is shown in an exploded state in FIG. 4B to illustrate the manner in which the gear set 490 is received within the gear receptacle 465 of the housing 415; however, in connection with FIG. 4B, the actuator device 175 is described below in its non-exploded state. In this regard, the gear set 490 extends within the gear receptacle 465 of the housing 415 and includes gears 500*a-b* and shafts 505*a-b*. The surface 485 of the housing 415 is profiled to receive the gears 500*a-b*. The gear 500*a* is mounted on the shaft 505*a*, which shaft 505*a* is received within, and supported by, the bearing hole 470 of the housing 415 so that the gear 500*a* overlaps the end wall 440*a* of the housing 415. Similarly, the gear 500*b* is mounted on the shaft 505*b*, and the gear 500*b* is received within, and supported by, the gear hole 475 of the housing 415.

Figure 4C:
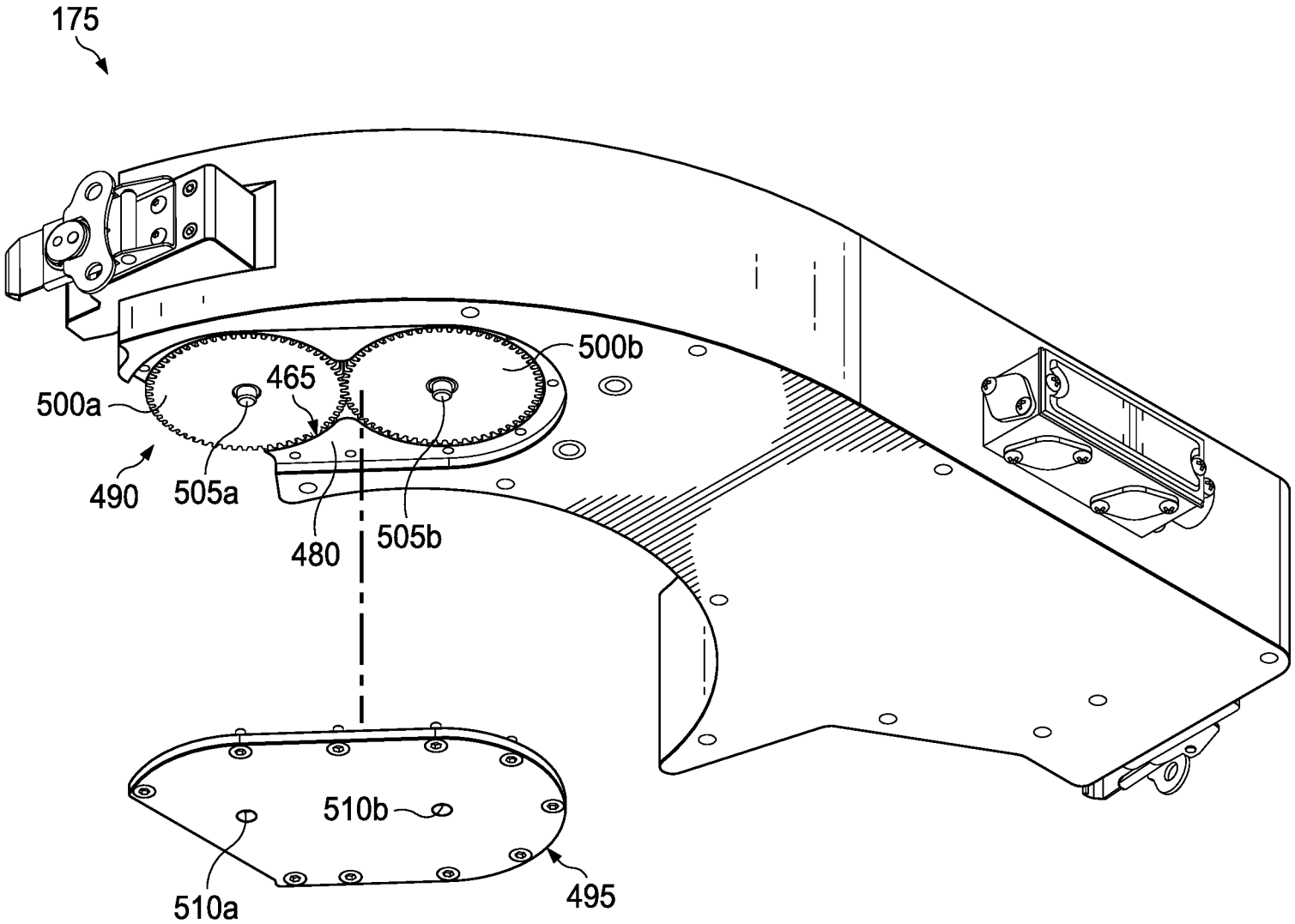
FIG. 4C is an exploded bottom perspective view of FIG. 4B's actuator device including the second housing, the gear set, and a first bearing plate, according to one or more embodiments.

Referring to FIG. 4C, with continuing reference to FIGS. 4A and 4B, in an embodiment, the actuator device 175 further includes a bearing plate 495. The actuator device 175 is shown in an exploded state in FIG. 4C to illustrate the manner in which the bearing plate is fastened to the shoulder 480 of the housing 415; however, in connection with FIG. 4C, the actuator device 175 is described below in its non-exploded state. In this regard, the bearing plate 495 is fastened to the shoulder 480 of the housing 415 to contain the gears 500*a-b* within the gear receptacle 465. Bearing holes 510*a-b* are formed in the bearing plate 495. The shafts 505*a-b* extend within the bearing holes 510*a-b* to support the gears 500*a-b* within the gear receptacle 465.

Figure 4D:
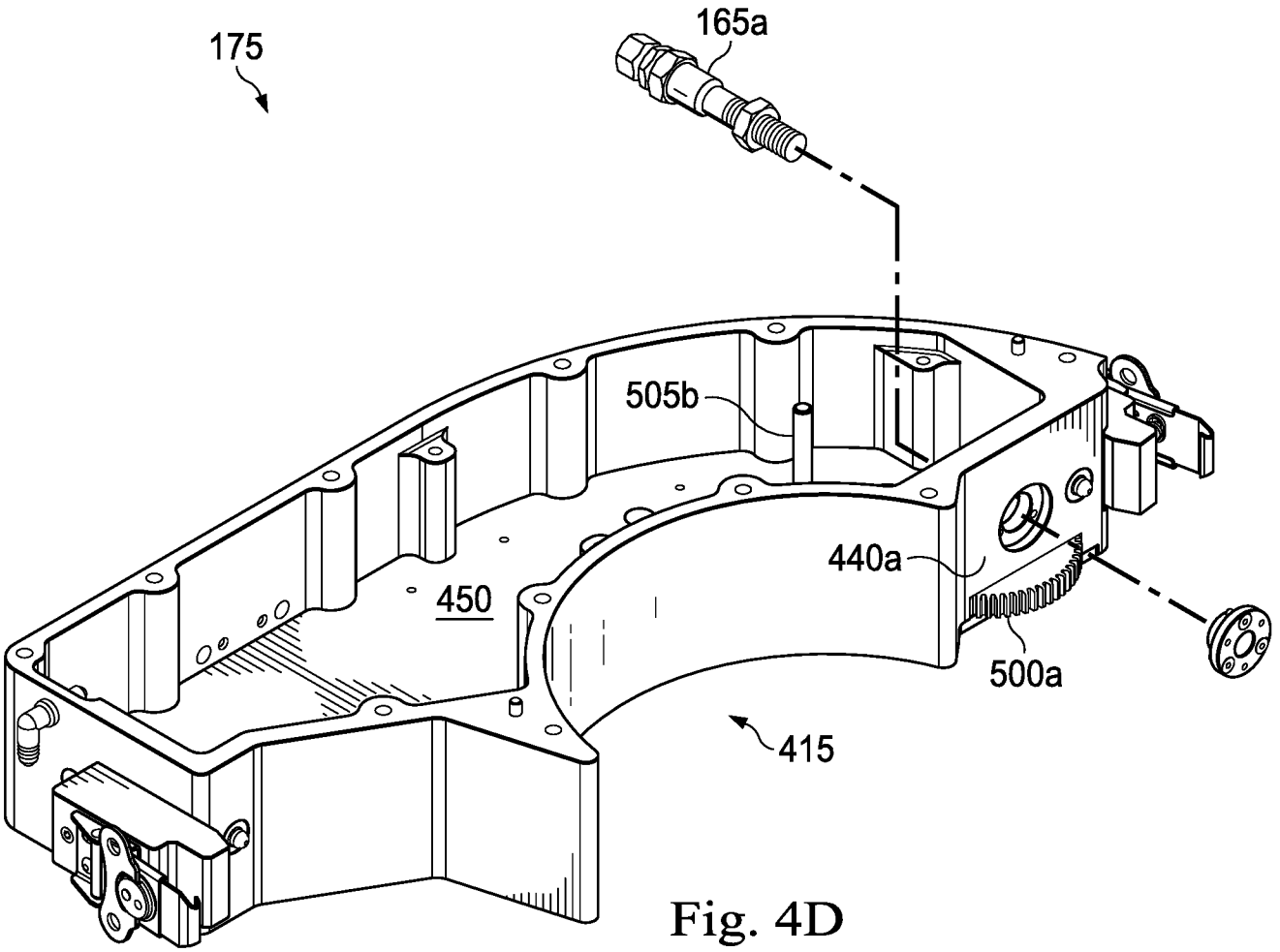
FIG. 4D is an exploded top perspective view of FIG. 4C's actuator device including the second housing, the gear set, the first bearing plate, and a first position sensor, according to one or more embodiments.

Referring to FIG. 4D, with continuing reference to FIGS. 4A through 4C, in an embodiment, the actuator device 175 further includes the position sensor 165*a*. The actuator device 175 is shown in an exploded state in FIG. 4D to illustrate the manner in which the position sensor 165*a* is fastened to the end wall 440*a* of the housing 415; however, in connection with FIG. 4D, the actuator device 175 is described below in its non-exploded state. In this regard, the position sensor 165*a* extends within the internal cavity 450 of the housing 415 and is fastened to the end wall 440*a*.

Figure 4E:
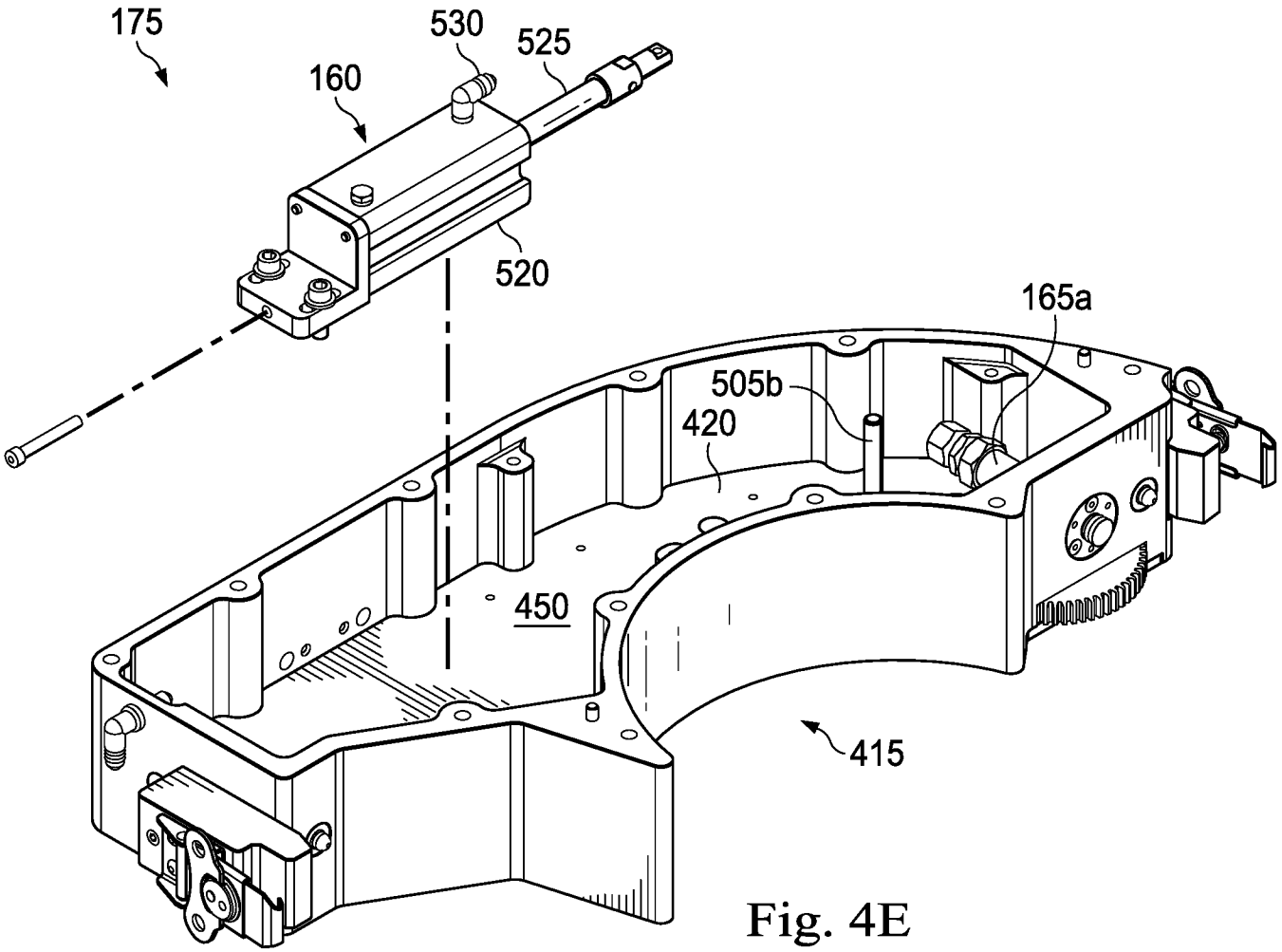
FIG. 4E is an exploded top perspective view of FIG. 4D's actuator device including the second housing, the gear set, the first bearing plate, the first position sensor, and a hydraulic actuator, according to one or more embodiments.

Referring to FIG. 4E, with continuing reference to FIGS. 4A through 4D, in an embodiment, the actuator device 175 further includes the hydraulic actuator 160. The actuator device 175 is shown in an exploded state in FIG. 4E to illustrate the manner in which the hydraulic actuator 160 is fastened to the deck plate 420 of the housing 415; however, in connection with FIG. 4E, the actuator device 175 is described below in its non-exploded state. In this regard, the hydraulic actuator 160 extends within the internal cavity 450 of the housing 415 and is fastened to the deck plate 420. The hydraulic actuator 160 includes a barrel 520 and a piston rod 525. The piston rod 525 extends out of the barrel 520, which barrel 520 includes a rod-end port 530 to and from which hydraulic fluid is communicable. This piston rod 525 is adapted to reciprocate into and out of the barrel 520 when hydraulic fluid is communicated to and from the rod-end port 530, as will be described in further detail below.

Figure 4F:
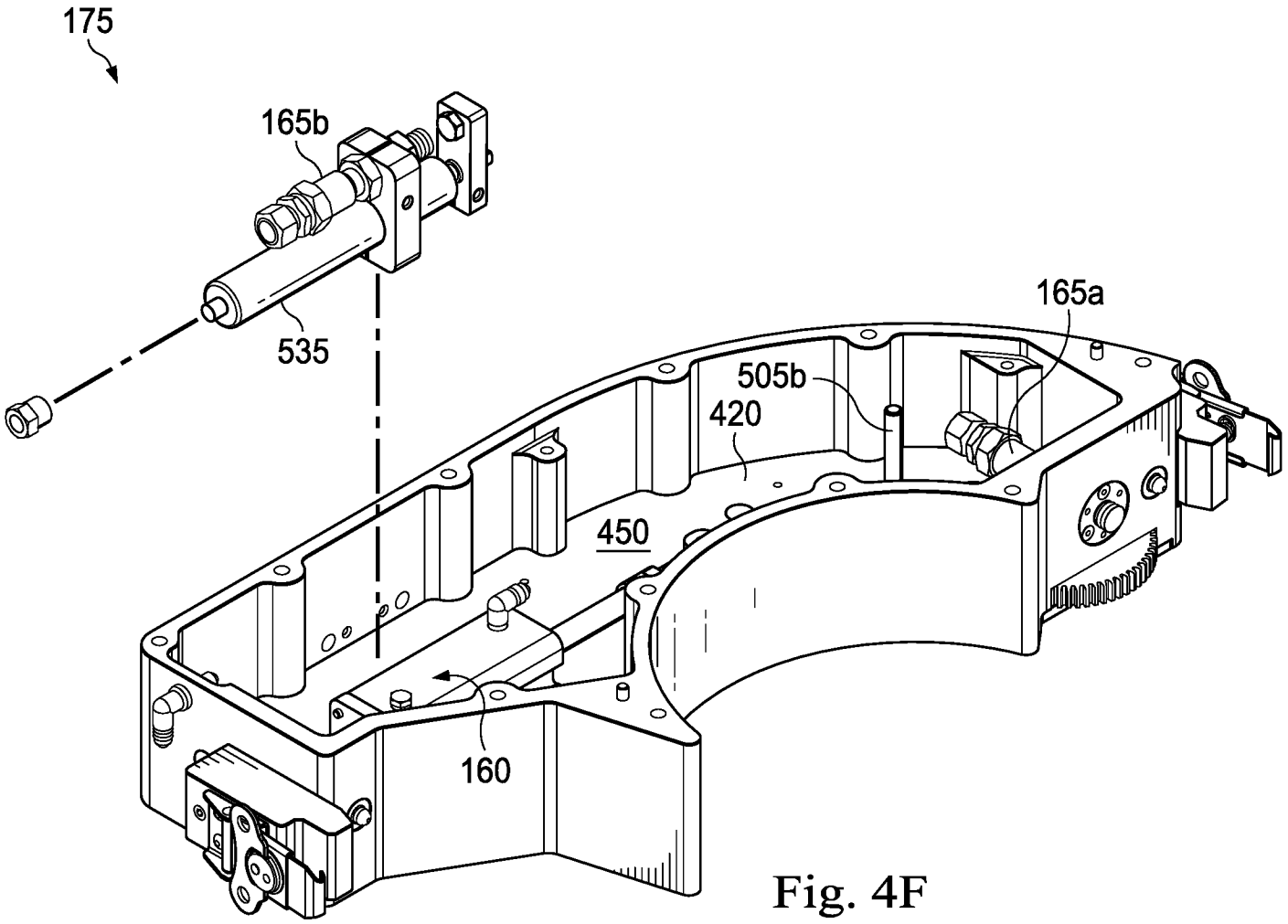
FIG. 4F is an exploded top perspective view of FIG. 4E's actuator device including the second housing, the gear set, the first bearing plate, the first position sensor, the hydraulic actuator, a biasing device, and a second position sensor, according to one or more embodiments.

Referring to FIG. 4F, with continuing reference to FIGS. 4A through 4E, in an embodiment, the actuator device 175 further includes a biasing device 535. The actuator device 175 is shown in an exploded state in FIG. 4F to illustrate the manner in which the biasing device 535 is fastened to the deck plate 420 of the housing 415; however, in connection with FIG. 4F, the actuator device 175 is described below in its non-exploded state. In this regard, the biasing device 535 extends within the internal cavity 450 of the housing 415 and is fastened to the deck plate 420 proximate the hydraulic actuator 160. The position sensor 165*b* is connected to the biasing device 535 to measure any change in the length (i.e., lengthening or shortening) of the biasing device 535.

Figure 4G:
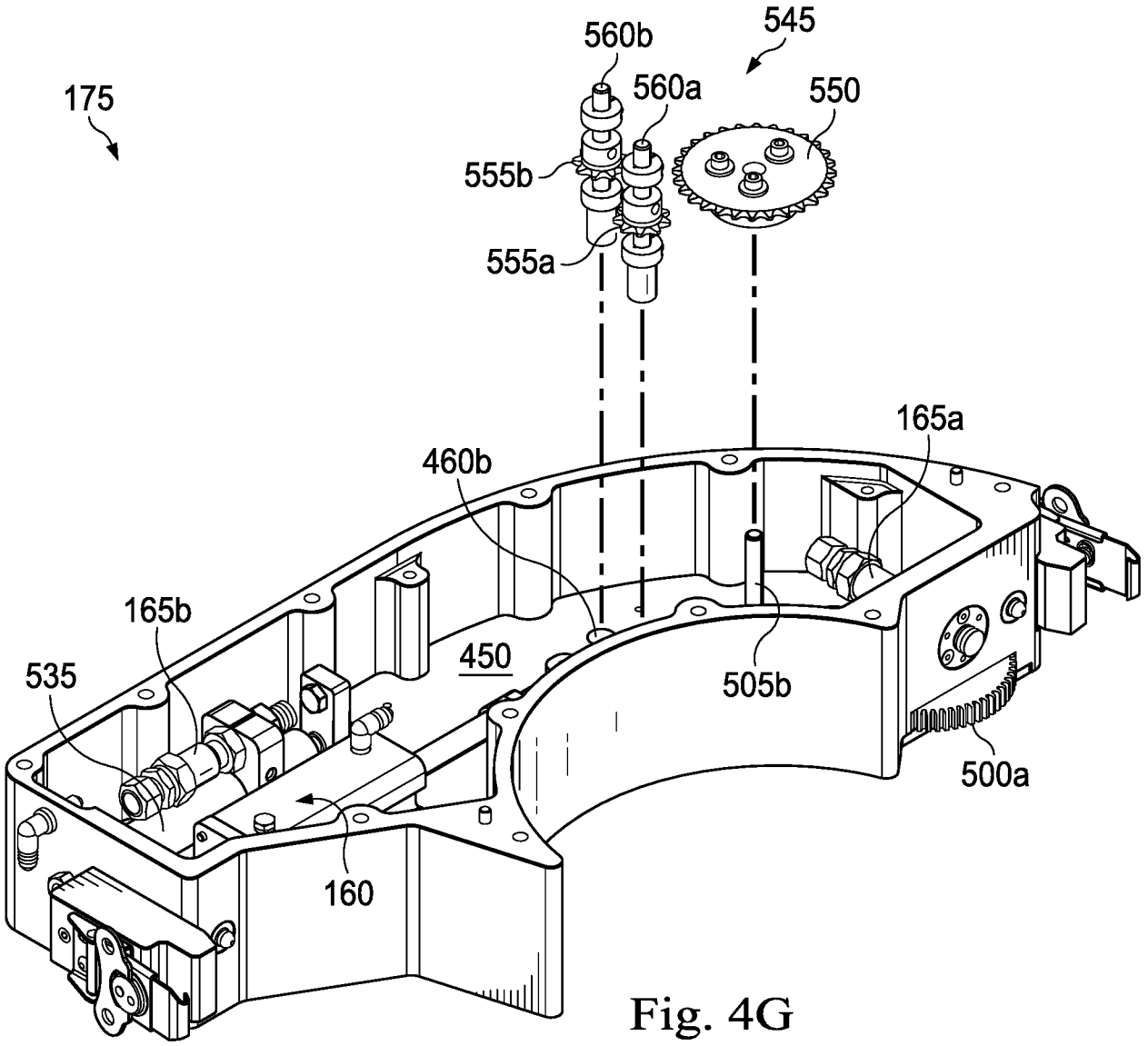
FIG. 4G is an exploded top perspective view of FIG. 4F's actuator device including the second housing, the gear set, the first bearing plate, the first position sensor, the hydraulic actuator, the biasing device, the second position sensor, and a sprocket set, according to one or more embodiments.

Referring to FIG. 4G, with continuing reference to FIGS. 4A through 4F, in an embodiment, the actuator device 175 further includes a sprocket set 545. The actuator device 175 is shown in an exploded state in FIG. 4G to illustrate the manner in which the sprocket set 545 is received within the internal cavity 450 of the housing 415; however, in connection with FIG. 4G, the actuator device 175 is described below in its non-exploded state. In this regard, the sprocket set 545 extends within the internal cavity 450 of the housing 415 and includes a drive sprocket 550 and idler sprockets 555*a-b*. The drive sprocket 550 is mounted on the shaft 505*b* and is fastened to the gear 500*b* (shown in FIG. 4B; not visible in FIG. 4G). The idler sprockets 555*a-b* are mounted on shafts 560*a-b*, respectively, which shafts 560*a-b* are received within the bearing holes 460*a-b*, respectively, of the housing 415 to support the idler sprockets 555*a-b*.

Figure 4H:
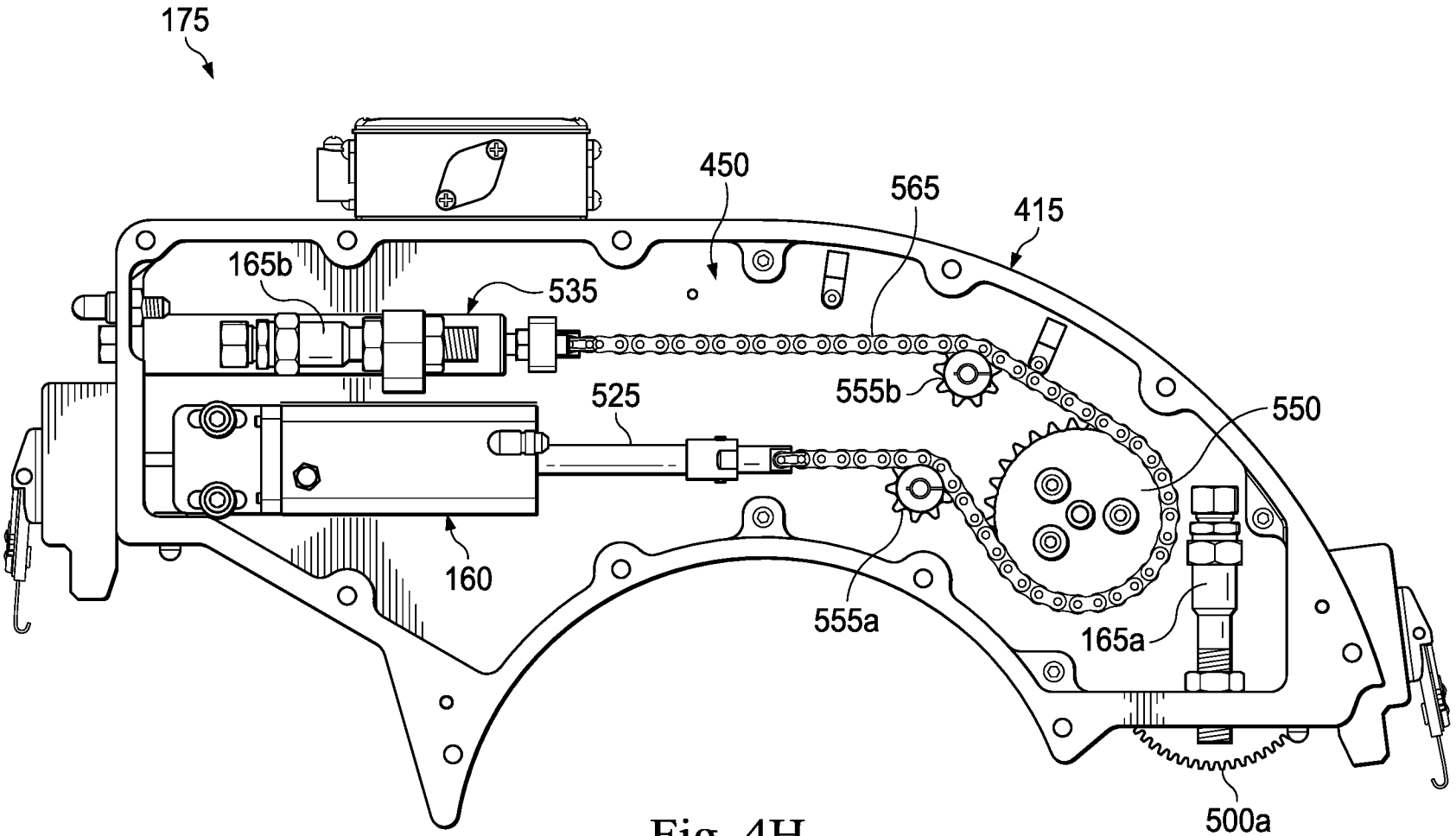
FIG. 4H is a top plan view of FIG. 4Gs actuator device including the second housing, the gear set, the first bearing plate, the first position sensor, the hydraulic actuator, the biasing device, the second position sensor, the sprocket set, and a chain, according to one or more embodiments.

Referring to FIG. 4H, with continuing reference to FIGS. 4A through 4G, in an embodiment, the actuator device 175 further includes a chain 565 extending within the internal cavity 450 of the housing 415. The chain 565 is connected at one end to the piston rod 525 of the hydraulic actuator 160 and, at the other end, to the biasing device 535. The chain 565 is carried by the drive sprocket 550 and the idler sprockets 555*a-b* so that actuation of the hydraulic actuator 160 causes rotation of the drive sprocket 550, the idler sprockets 555*a-b*, and the gears 500*a-b*, as will be described in further detail below.

Figure 4I:
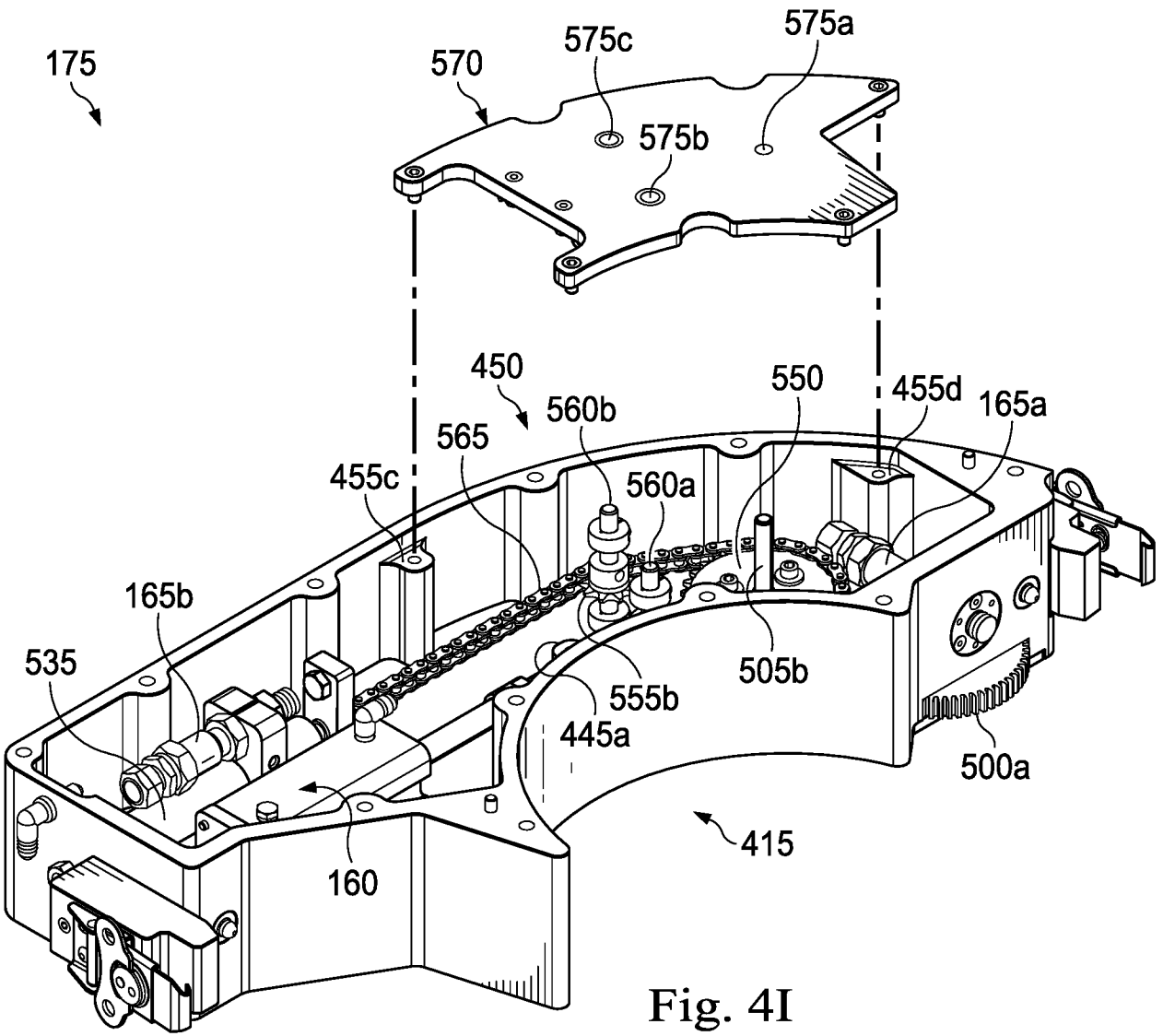
FIG. 4I is an exploded top perspective view of FIG. 4H's actuator device including the second housing, the gear set, the first bearing plate, the first position sensor, the hydraulic actuator, the biasing device, the second position sensor, the sprocket set, the chain, and a second bearing plate, according to one or more embodiments.

Referring to FIG. 4I, with continuing reference to FIGS. 4A through 4H, in an embodiment, the actuator device 175 further includes a bearing plate 570. The actuator device 175 is shown in an exploded state in FIG. 4I to illustrate the manner in which the bearing plate 570 is fastened to the bearing plate supports 455*a-d*; however, in connection with FIG. 4I, the actuator device 175 is described below in its non-exploded state. In this regard, the bearing plate 570 extends within the internal cavity 450 of the housing 415 and is fastened to the bearing plate 570 supports 455*a-d*. The bearing plate 570 includes bearing holes 575*a-c*. The shaft 505*b* extends within the bearing hole 575*a* to support the gear 500*b* and the drive sprocket 550. Similarly, the shafts 560*a-b* extend within the bearing holes 575*b-c*, respectively, to support the idler sprockets 555*a-b*.

Figure 4J:
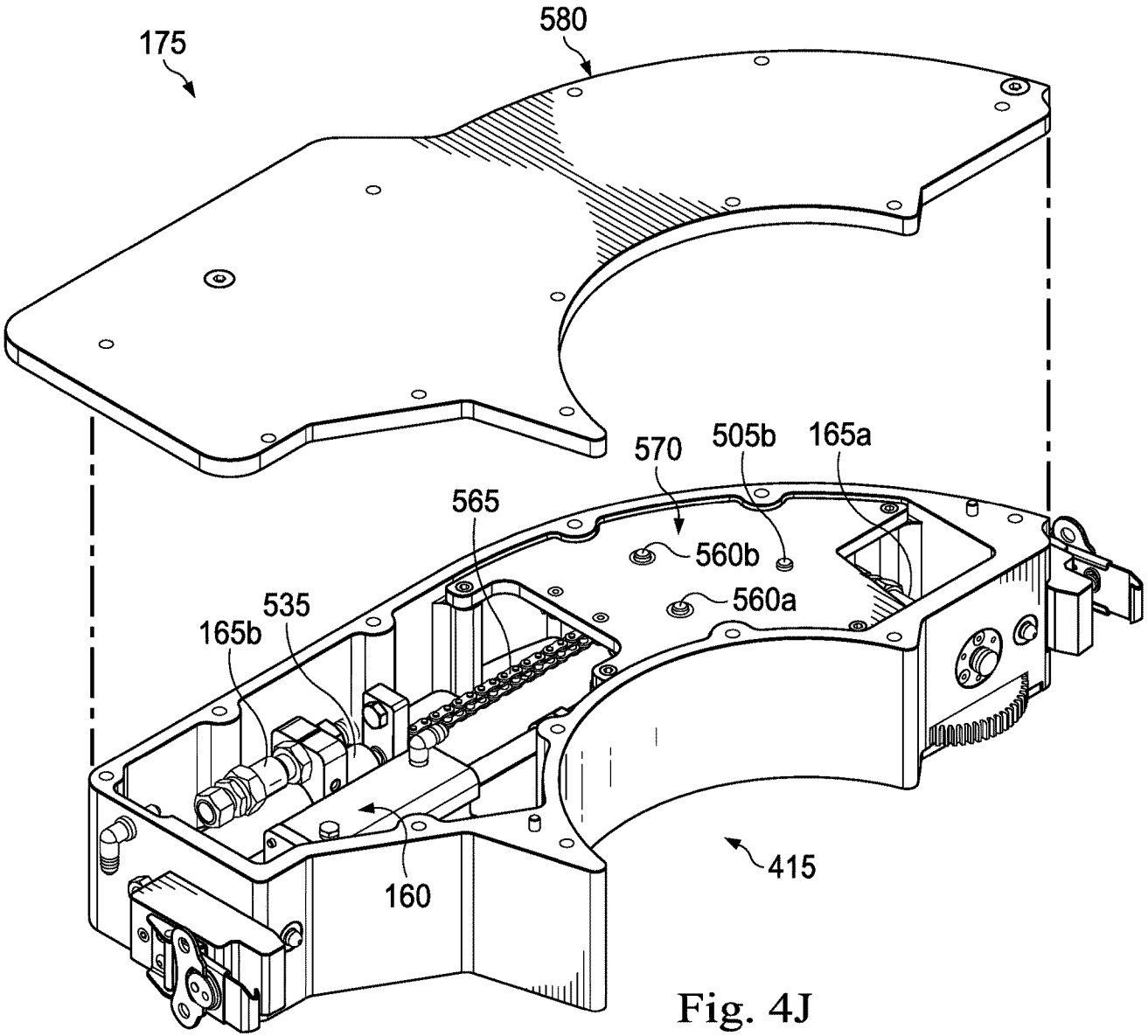
FIG. 4J is an exploded top perspective view of FIG. 4I's actuator device including the second housing, the gear set, the first bearing plate, the first position sensor, the hydraulic actuator, the biasing device, the second position sensor, the sprocket set, the chain, the second bearing plate, and a second cover plate, according to one or more embodiments.

Referring to FIG. 4J, with continuing reference to FIGS. 4A through 4I, in an embodiment, the actuator device 175 further includes a cover plate 580. The actuator device 175 is shown in an exploded state in FIG. 4J to illustrate the manner in which the cover plate 580 is fastened to the housing 415; however, in connection with FIG. 4J, the actuator device 175 is described below in its non-exploded state. In this regard, the cover plate 580 is fastened to the housing 415 to contain the position sensor 165*a*, the hydraulic actuator 160, the biasing device 535, the sprocket set 545, the chain 565, and the bearing plate 570 within the housing 415.

Figure 5:
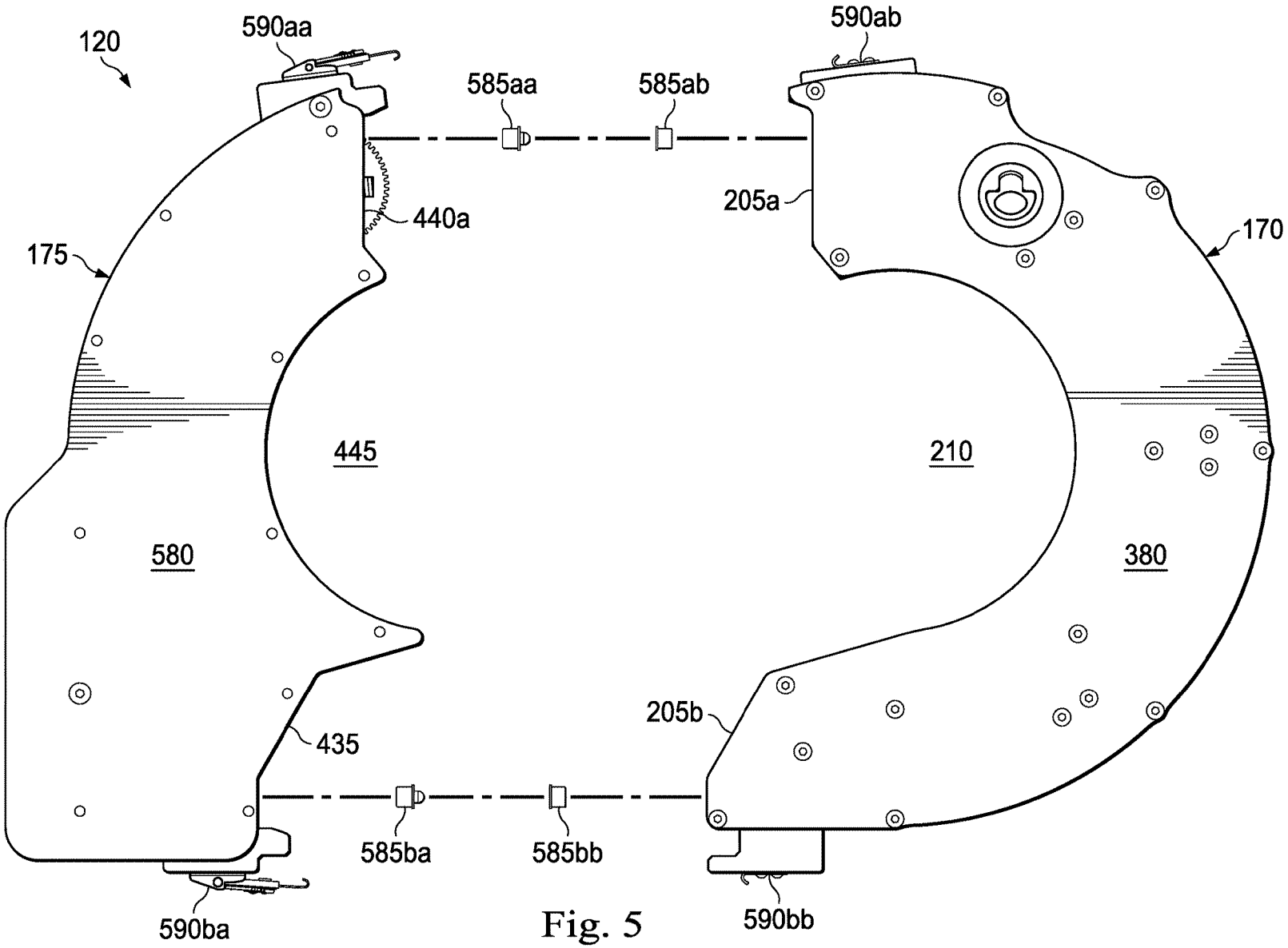
FIG. 5 is an exploded top plan view of FIG. 2's launcher, according to one or more embodiments.

Referring to FIG. 5, with continuing reference to FIGS. 3G and 4J, in an embodiment, the launcher 120 further includes guide members 585*aa*, 585*ab*, 585*ba*, and 585*bb*, and clasp members 590*aa*, 590*ab*, 590*ba*, and 590*bb*. The launcher 120 is shown in an exploded state in FIG. 5 to illustrate the manner in which the kicker device 170 and the actuator device 175 are guided together by the guide members 585*aa*, 585*ab*, 585*ba*, and 585*bb*, and held together by the claps members 590*aa*, 590*ab*, 590*ba*, and 590*bb*; however, in connection with FIG. 5, the launcher 120 is described below in its non-exploded state. In this regard, the kicker device 170 and the actuator device 175 are guided together by the guide members 585*aa*, 585*ab*, 585*ba*, and 585*bb*, and held together by the clasp members 590*aa*, 590*ab*, 590*ba*, and 590*bb*. More particularly, the guide members 585*aa* and 585*ab* together guide the end walls 205*a* and 440*a* of the kicker device 170 and the actuator device 175, respectively, into mating engagement. Further, the clasp members 590*aa* and 590*ab* together secure the end walls 205*a* and 440*a* of the kicker device 170 and the actuator device 175, respectively, in said mating engagement. Further still, the guide members 585*ba* and 585*bb* together guide the end wall 205*b* of the kicker device 170 into mating engagement with the intermediate wall 435 of the actuator device 175. Finally, the clasp members 590*ba* and 590*bb* together secure the end walls 205*b* of the kicker device 170 in said mating engagement with the intermediate wall 435 of the actuator device 175. As a result, the exterior recess 210 of the kicker device 170 adjoins the exterior recess 445 of the actuator device 175 so that, in combination, the exterior recesses 210 and 445 form a central passageway 595 (shown in FIGS. 2, 6A-1, 6B-1, and 6C-1) through the launcher 120.

Figures 1, 6A:
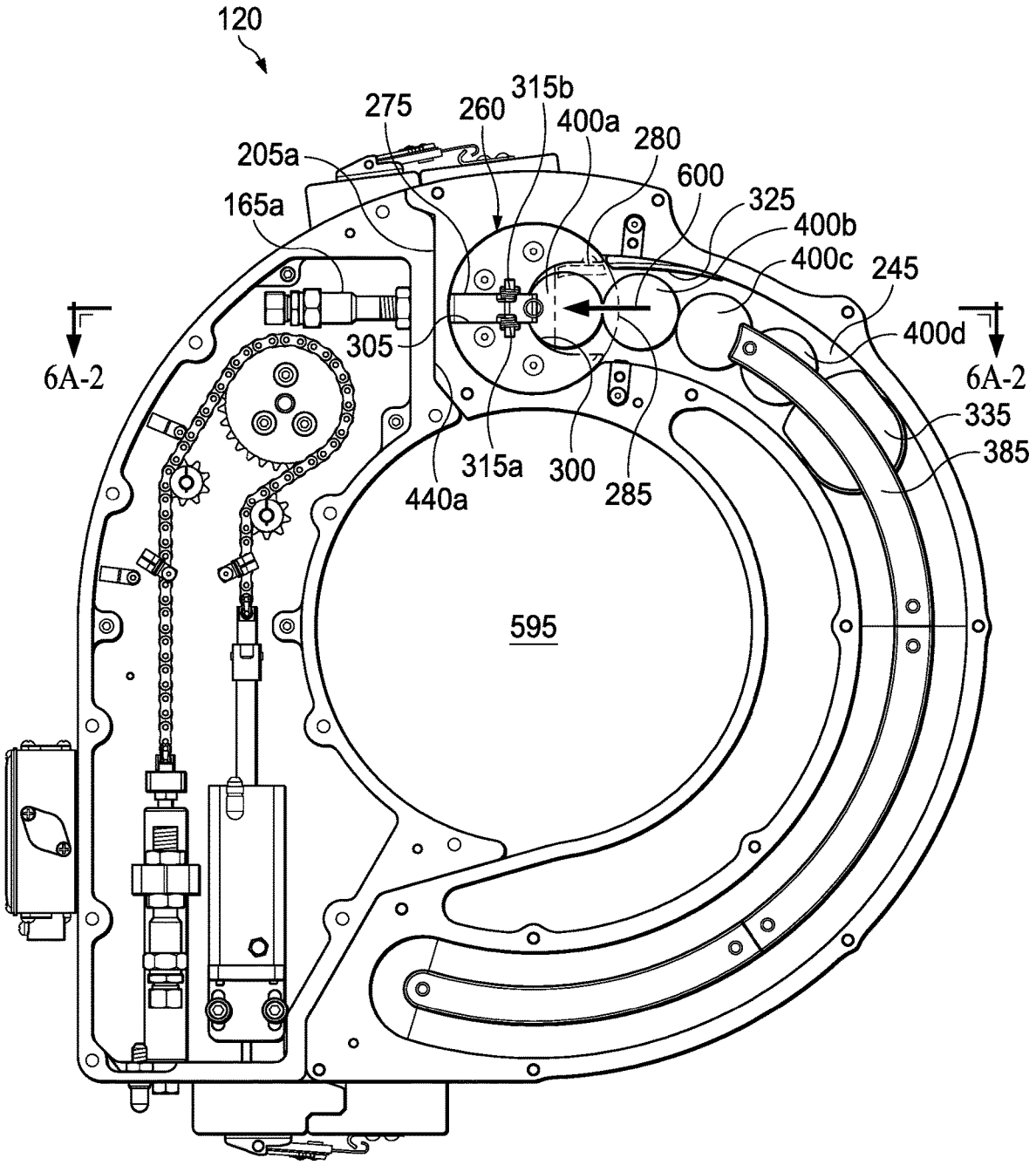
Figures 2, 6A:
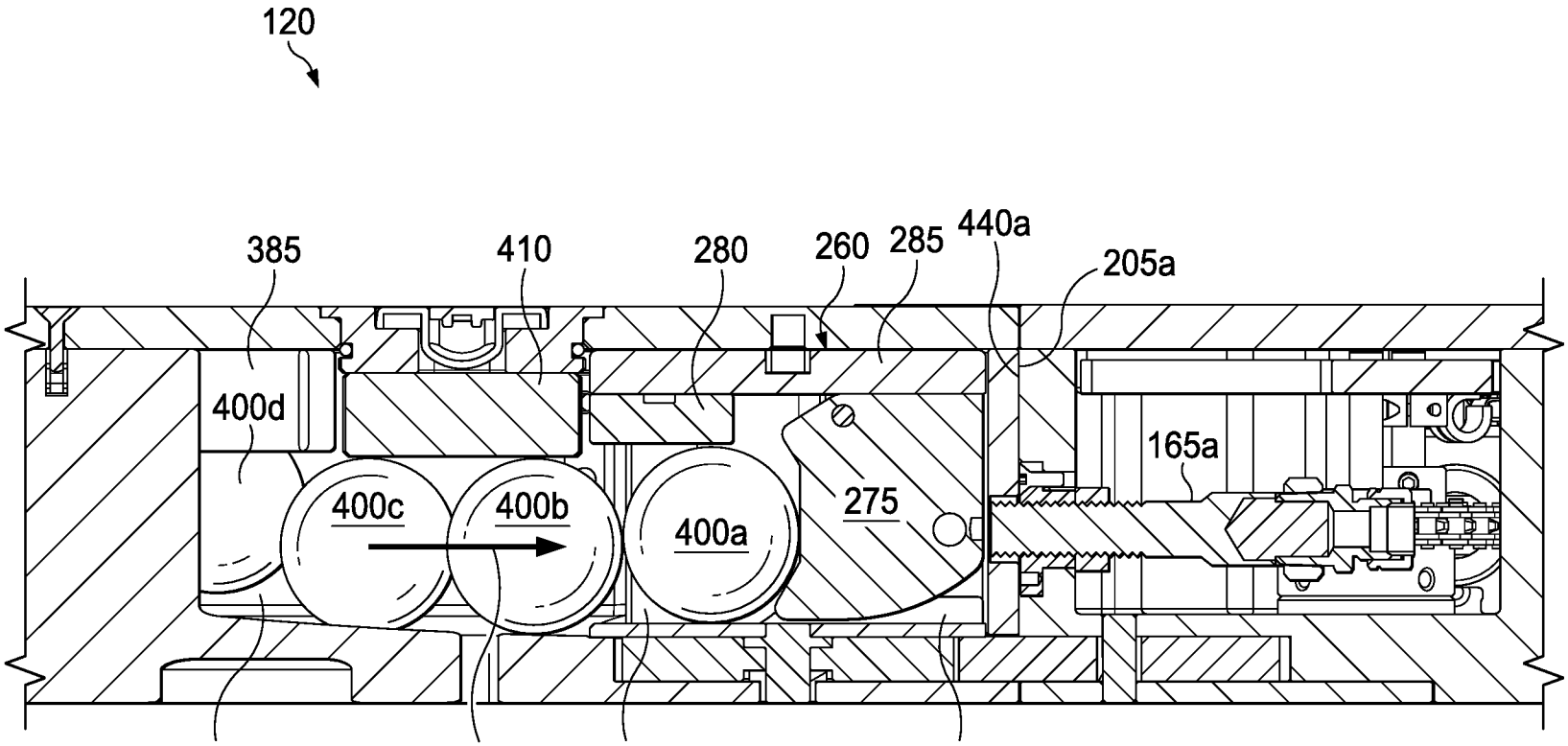
Figures 3, 6A:
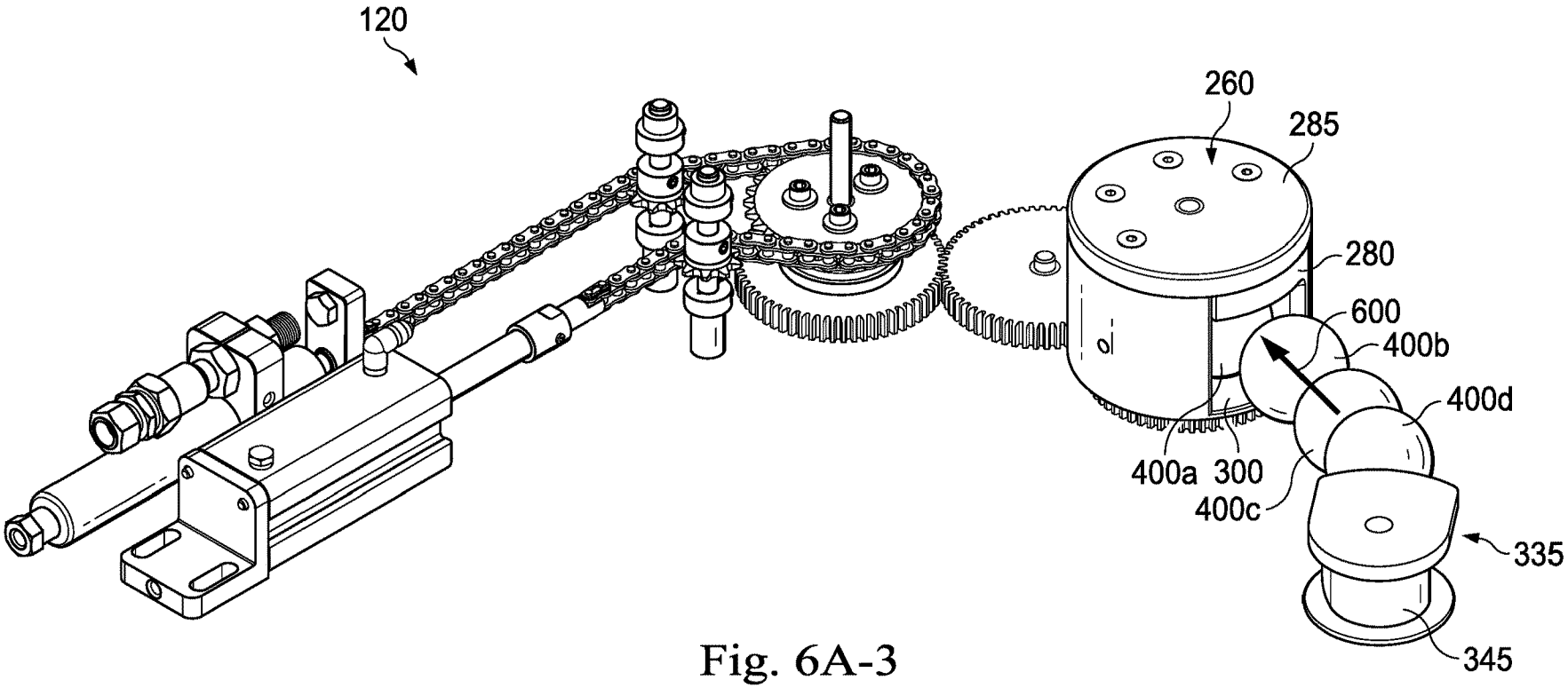

Referring to FIGS. 6A-1 through 6A-3, with continuing reference to FIGS. 1 through 5, in operation, the follower 335 displaces the ball 400*a* into the chamber 300 of the kicker 260, as indicated by the linear arrow 600. For example, the direction 600 may be either transverse or skew to axis 610 (shown in FIGS. 6B-1 through 6C-3). More particularly, the follower 335 applies a force against the ball 400*d*, which force is generated by the spring 345 of the follower 335. The balls 400*b-c* transmit the force applied against the ball 400*d* to the ball 400*a*. As a result, the ball 400*a* overcomes the biasing force of the springs 315*a-b* and pushes the foot 275 of the kicker 260 out of the chamber 300 and into the foot receptacle 305. Alternatively, the ball 400*a* may be gravity-fed (e.g., via a ramped surface of the housing 180) into the chamber 300. FIGS. 6A-1 through 6A-3 illustrate an embodiment wherein the direction 600 in which the ball 400*a* is loaded is transverse to the axis 610 (shown in FIGS. 6B-1 through 6C-3). Alternatively, the direction 600 in which the ball 400*a* is loaded may be skew to the axis 610 and thus neither intersecting nor parallel to the axis 610. During the displacement of the ball 400*a* into the chamber 300, the shims 280 and 325 guide the ball 400*a* to prevent jamming of the ball 400*a* as it enters the chamber 300, and the shims 325, 385, and 410 guide the balls 400*b-d* to prevent jamming of the balls 400*b-d* within the magazine cavity 245. The position sensor 165*a* detects the presence of the foot 275 within the foot receptacle 305 and transmits signals based on such detection to the control unit 130 via the analog I/O 140 (as shown in FIG. 2). As a result, the control unit 130 is able to determine whether the ball 400*a* has been properly loaded into the chamber 300. For clarity, various components of the launcher 120 have either been omitted from view or shown translucently in FIGS. 6A-1 through 6A-3.

Figures 1, 6B:
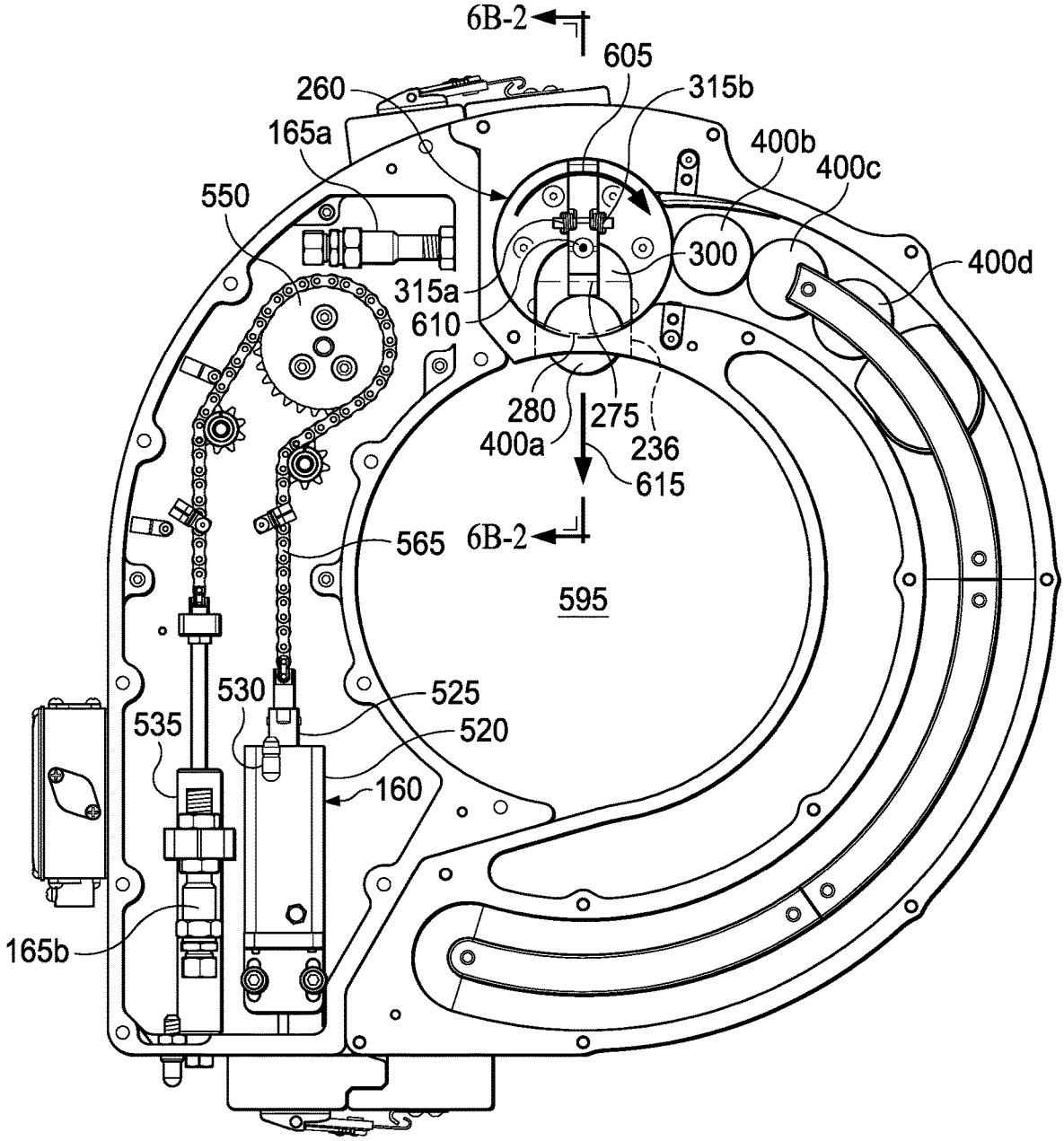
Figures 2, 6B:
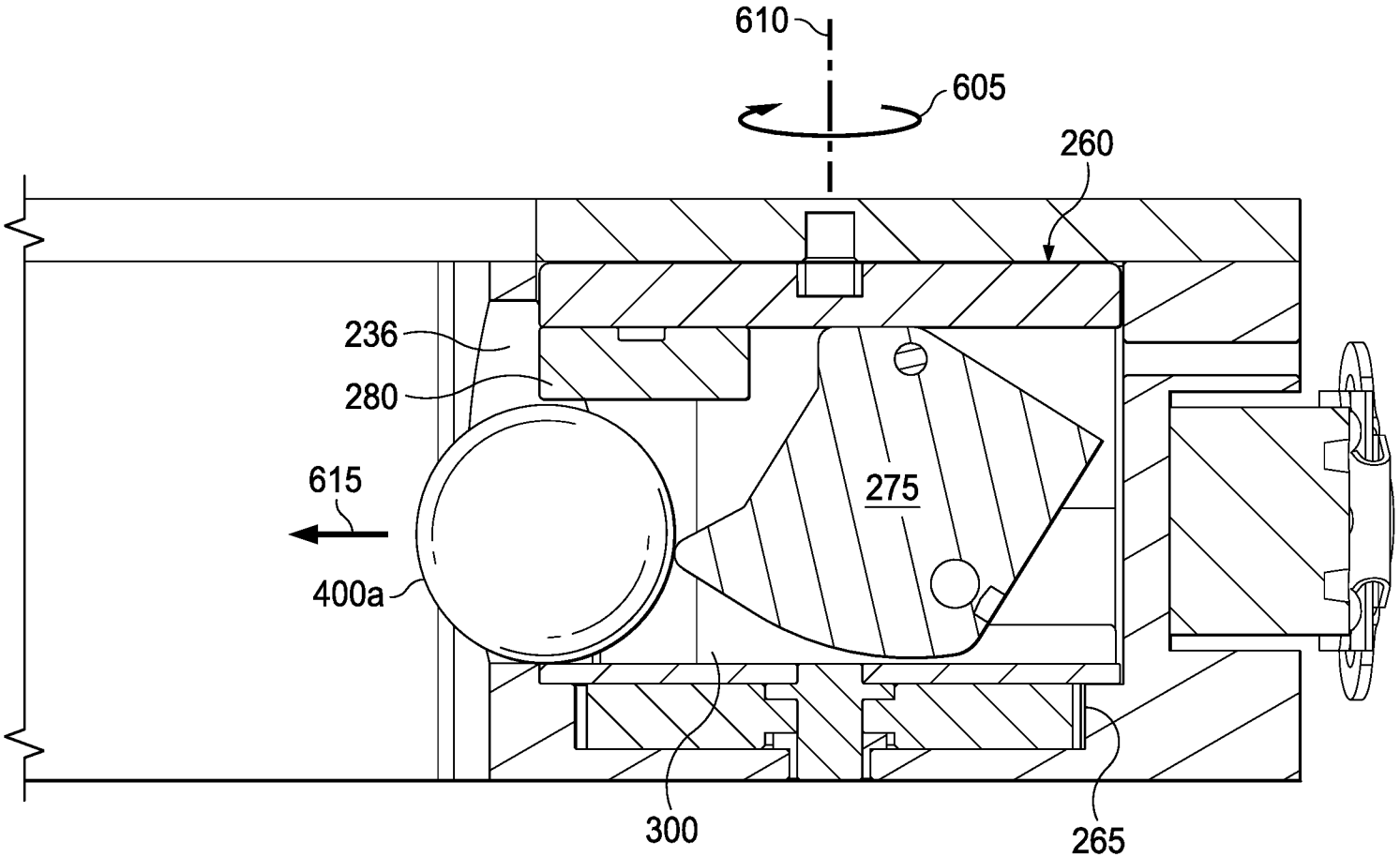
Figures 3, 6B:
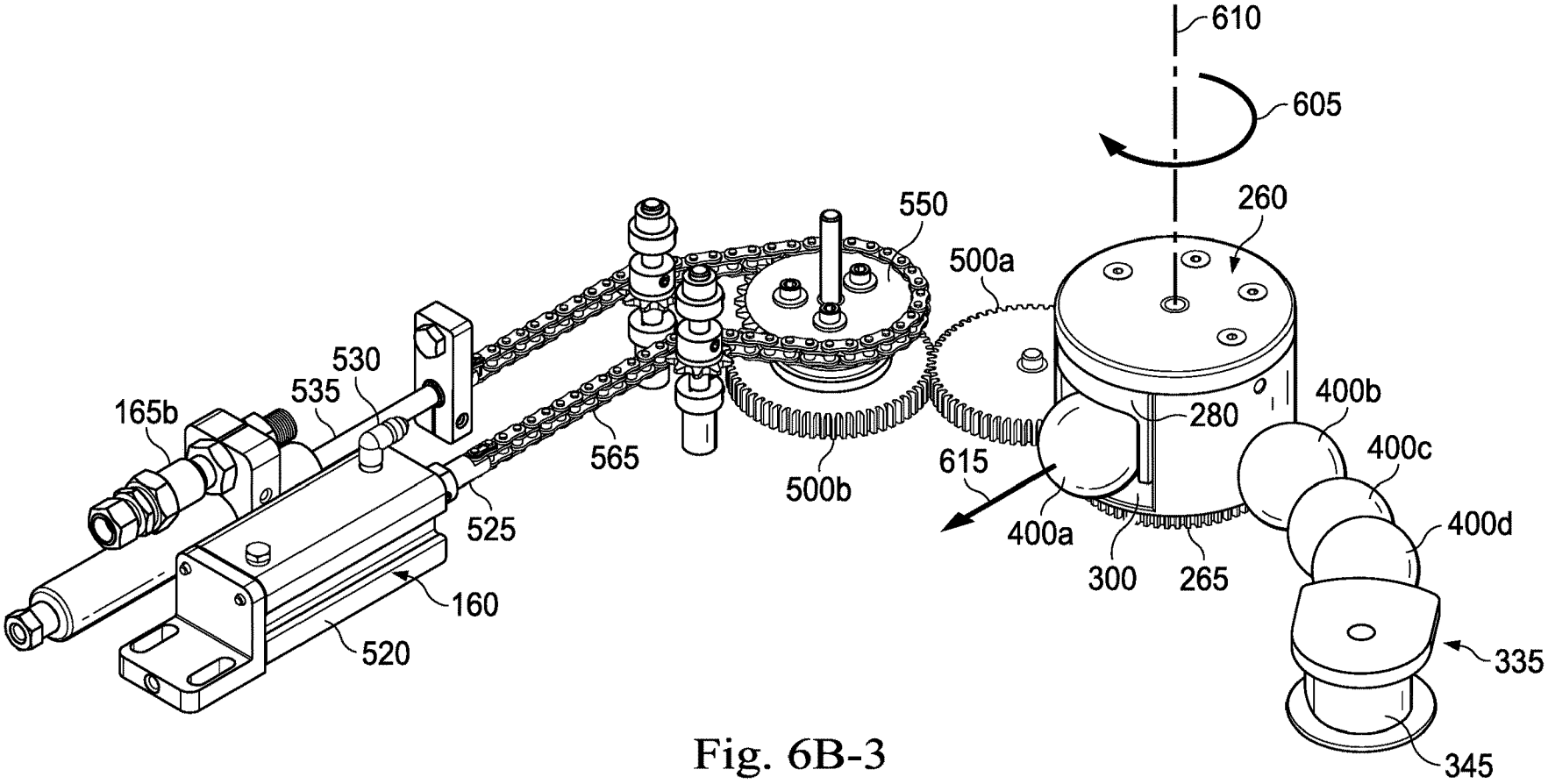

Referring to FIGS. 6B-1 through 6B-3, with continuing reference to FIGS. 6A-1 through 6A-3, in response to the signals transmitted to the control unit 130 by the position sensor 165*a*, the control unit 130 transmits signals to the hydraulic manifold 145 via the digital I/O 135, which signals cause the hydraulic manifold 145 to communicate hydraulic fluid to the hydraulic actuator 160 (as shown in FIG. 2). More particularly, the hydraulic manifold 145 communicates the hydraulic fluid to the rod-end port 530 to retract the piston rod 525 into the barrel 520. As a result, the chain 565 connected to the piston rod 525 rotates the drive sprocket 550 in a clockwise direction (as viewed in FIG. 6B-1) and lengthens the biasing device 535. The clockwise rotation of the drive sprocket 550 is transmitted to the kicker 260 via the gears 500*b*, 500*a*, and 265, respectively, thereby causing the kicker 260 to rotate until the chamber 300 is aligned with the opening 236, as indicated by the curvilinear arrow 605 in FIGS. 6B-1 through 6B-3. For example, the kicker 260 may rotate about the axis 610 (e.g., a vertical axis). Once the chamber 300 is so aligned with the opening 236, the springs 315*a* and 315*b* bias the foot 275 into the chamber 300 to eject the ball 400*a* into the central passageway 595, as indicated by the linear arrow 615 in FIGS. 6B-1 through 6B-3. For example, the direction 615 may be either transverse or skew to the axis 610. Alternatively, the object may be gravity-fed (e.g., via a ramped surface of the cylinder 270) out of the chamber 300 and into the central passageway 595 of the launcher 120. FIGS. 6B-1 through 6B-3 illustrate an embodiment wherein the direction 615 in which the ball 400*a* is ejected is transverse to the axis 610. Alternatively, the direction 615 in which the ball 400*a* is ejected may be skew to the axis 610 and thus neither intersecting nor parallel to the axis 610. The position sensor 165*b* detects the lengthening of the biasing device 535 and transmits signals based on such detection to the control unit 130 via the analog I/O 140 (as shown in FIG. 2). As a result, the control unit 130 is able to determine whether the chamber 300 has been properly aligned with the opening 236 to allow ejection of the ball 400*a* into the central passageway 595. For clarity, various components of the launcher 120 have either been omitted from view or shown translucently in FIGS. 6A-1 through 6A-3.

Figures 1, 6C:
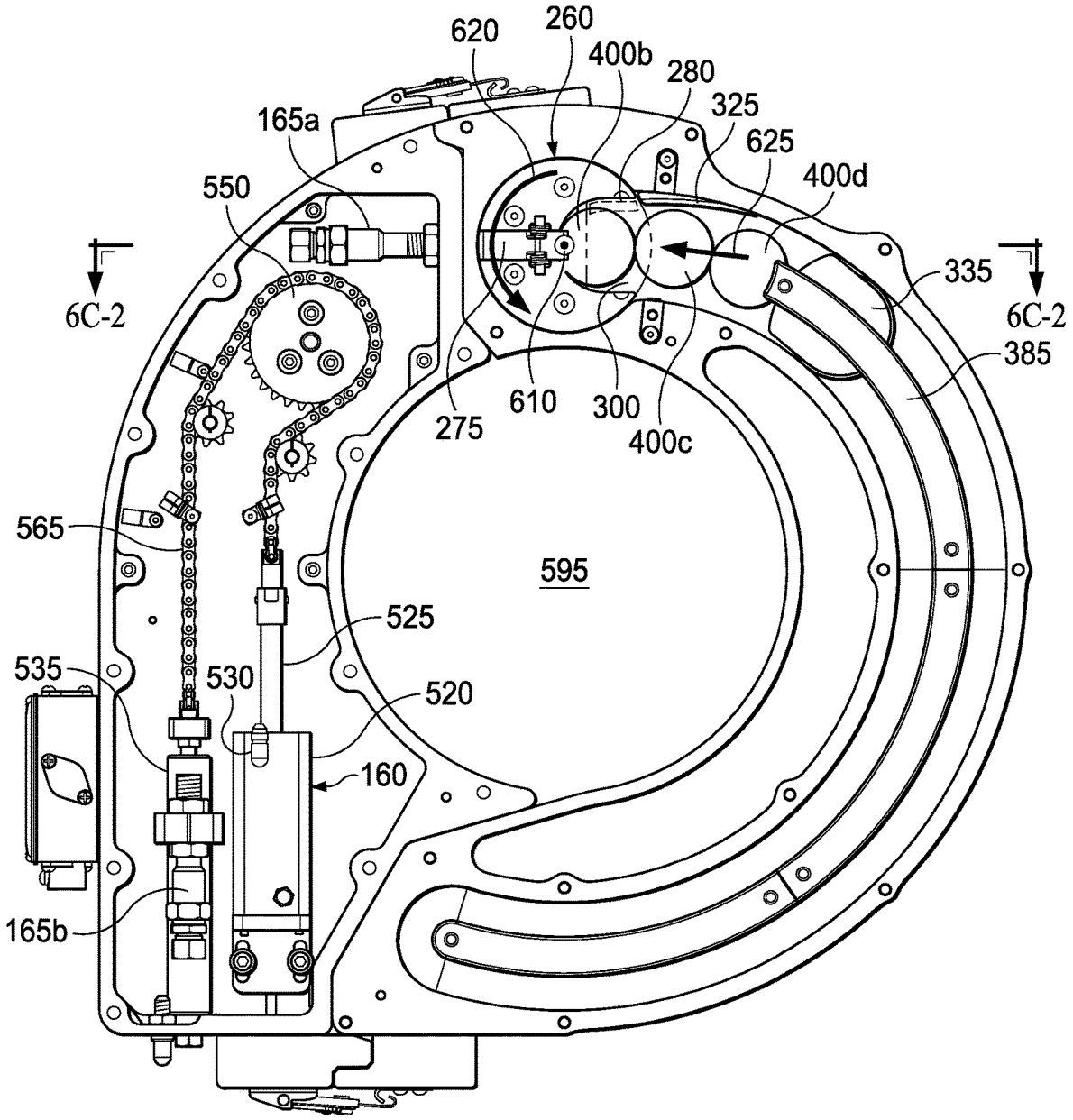
Figures 2, 6C:
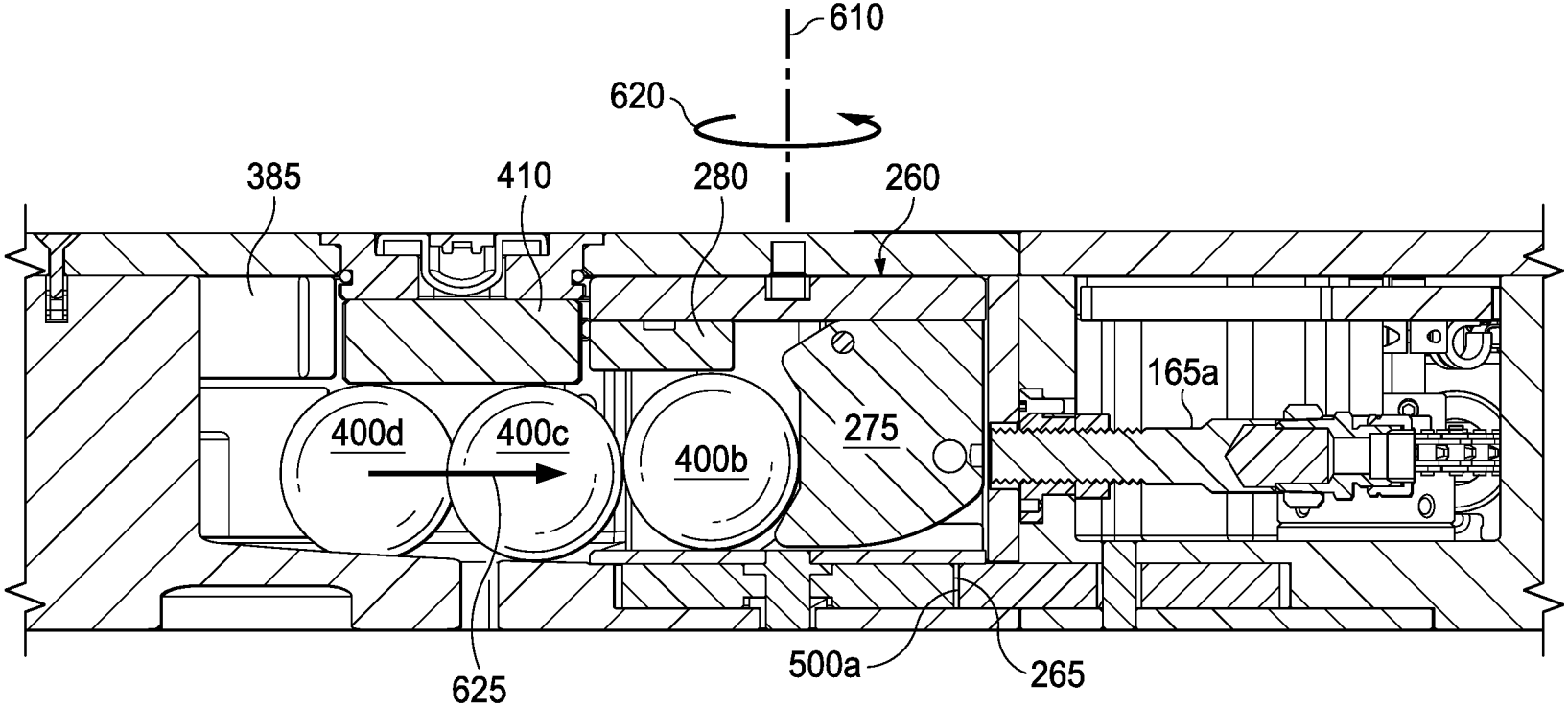
Figures 3, 6C:
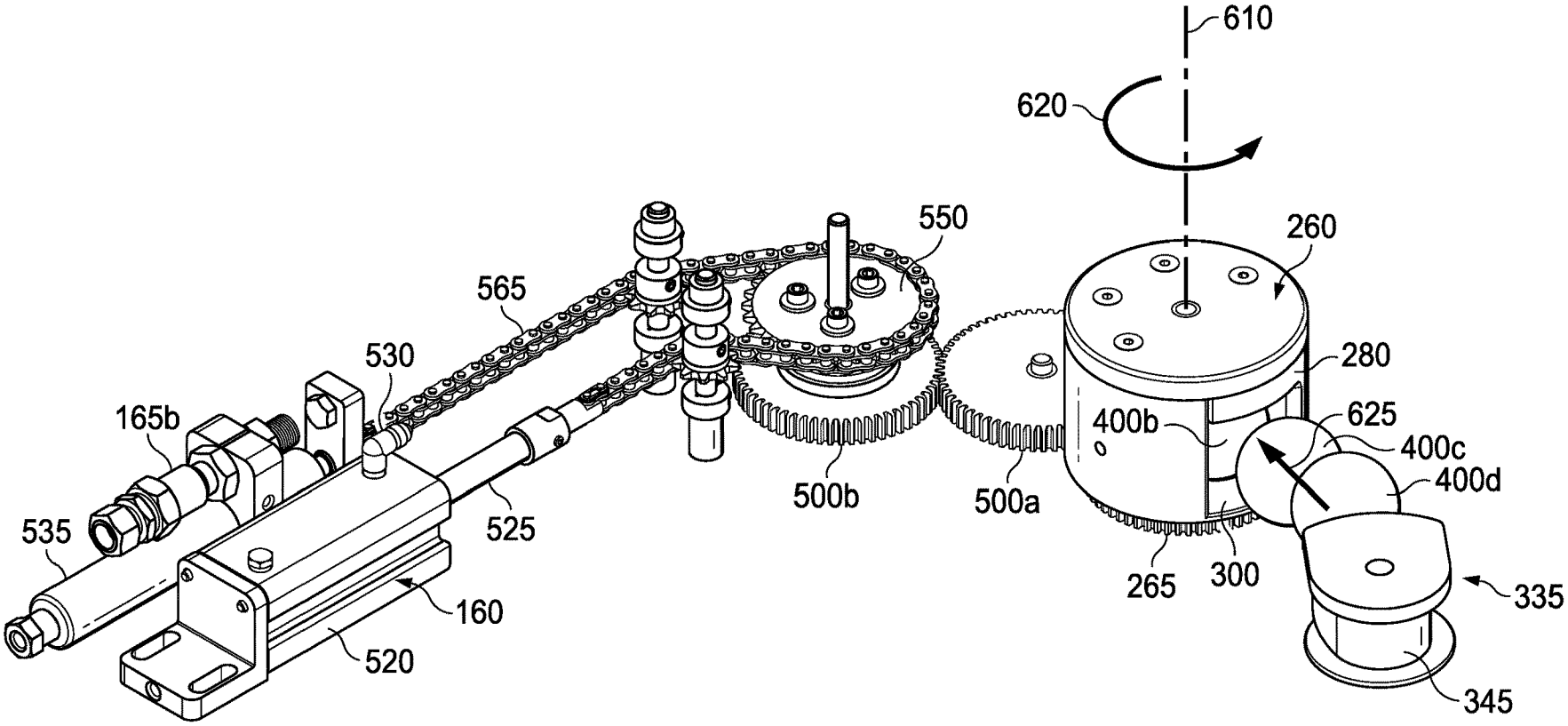
Figure 7:
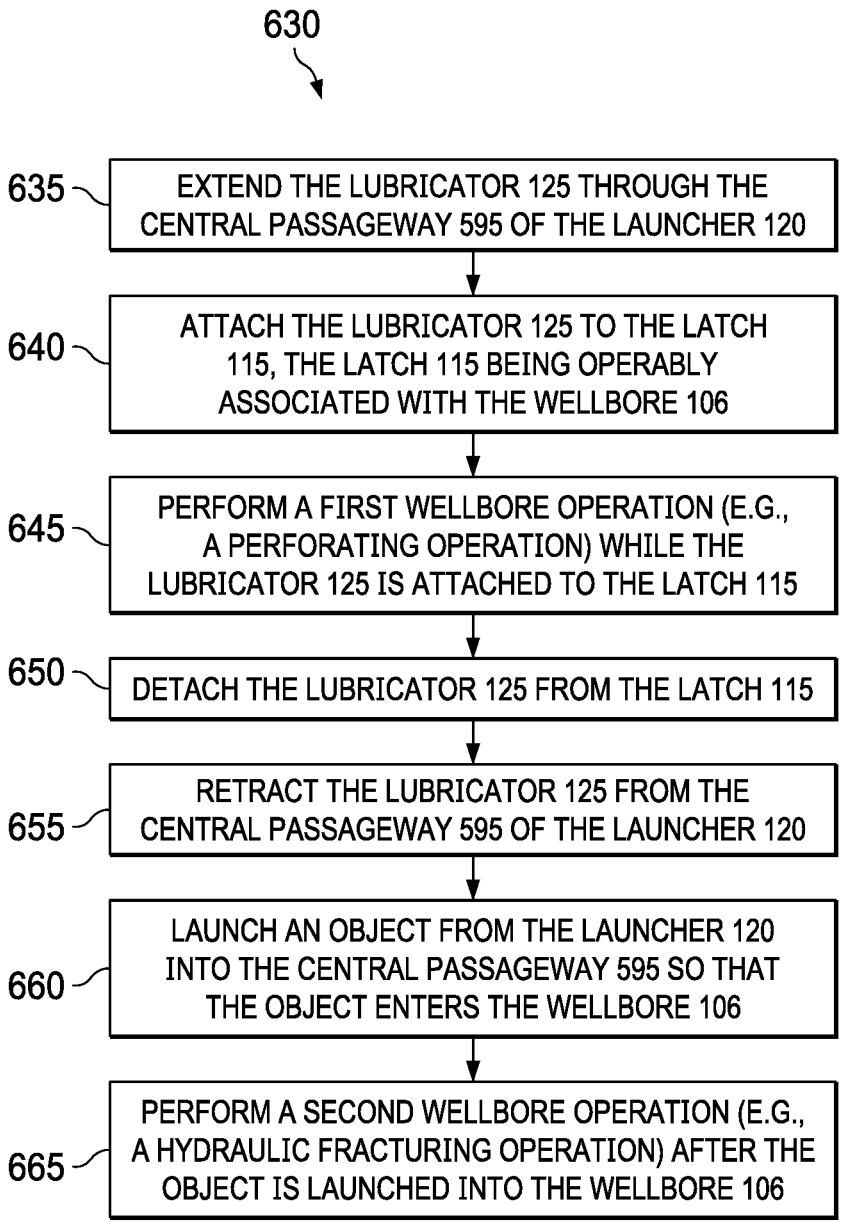
FIG. 7 is a flow diagram of a method for implementing one or more embodiments of the present disclosure.

Referring to FIGS. 6C-1 through 6C-3, with continuing reference to FIGS. 6B-1 through 6B-3, in response to the signals transmitted to the control unit 130 by the position sensor 165*b*, the control unit 130 transmits signals to the hydraulic manifold 145 via the digital I/O 135, which signals cause the hydraulic manifold to cease to communicate hydraulic fluid to the hydraulic actuator 160 (as shown in FIG. 1). As a result, the biasing device 535 shortens, thereby pulling on the chain 565 to rotate the drive sprocket 550 in a counterclockwise direction (as viewed in FIG. 6C-1) and pull the piston rod 525 out of the barrel 520, which expels hydraulic fluid from the rod-end port 530. The counterclockwise rotation of the drive sprocket 550 is transmitted to the kicker 260 via the gears 500*b*, 500*a*, and 265, respectively, thereby causing the kicker 260 to rotate until the chamber 300 is aligned with the magazine cavity 245, as indicated by the curvilinear arrow 620 in FIGS. 6C-1 through 6C-3. For example, the kicker 260 may rotate about the axis 610 (e.g., a vertical axis). The position sensor 165*a* detects the absence of the foot 275 within the foot receptacle 305 and transmits signals based on such detection to the control unit 130 via the analog I/O 140 (as shown in FIG. 2). As a result, the control unit 130 is able to determine whether the ball 400*a* has been properly ejected from the chamber 300. Once the chamber 300 is so aligned with the magazine cavity 245, the follower 335 displaces the ball 400*b* into the chamber 300 of the kicker 260, as indicated by the linear arrow 625. FIGS. 6C-1 through 6C-3 illustrate an embodiment wherein the direction 625 in which the ball 400*b* is loaded is transverse to the axis 610. Alternatively, the direction 625 in which the ball 400*b* is loaded may be skew to the axis 610 and thus neither intersecting nor parallel to the axis 610. The operation of the launcher to eject the ball 400*b* into the central passageway 595 is identical to that described above with respect to the ball 400*a* and, therefore, will not be described in further detail. This process may be until the remaining balls 400*b-d* are ejected into the central passageway 595.

Figure 8C:
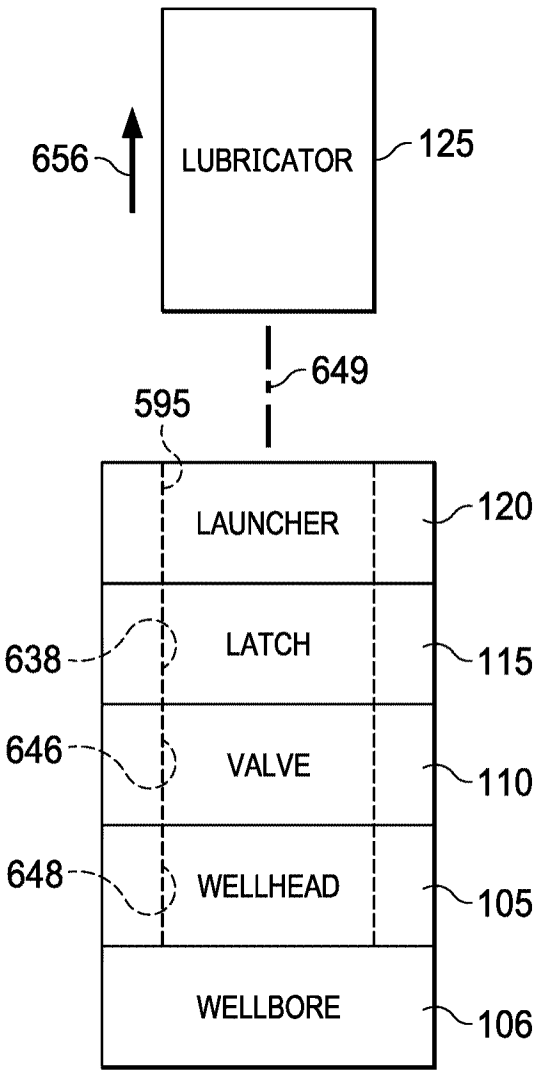
FIG. 8C is a diagrammatic illustration of the system of FIGS. 1 through 6C-3 in a third operational state or configuration during the execution of FIG. 7's method, according to one or more embodiments.
Figure 8B:
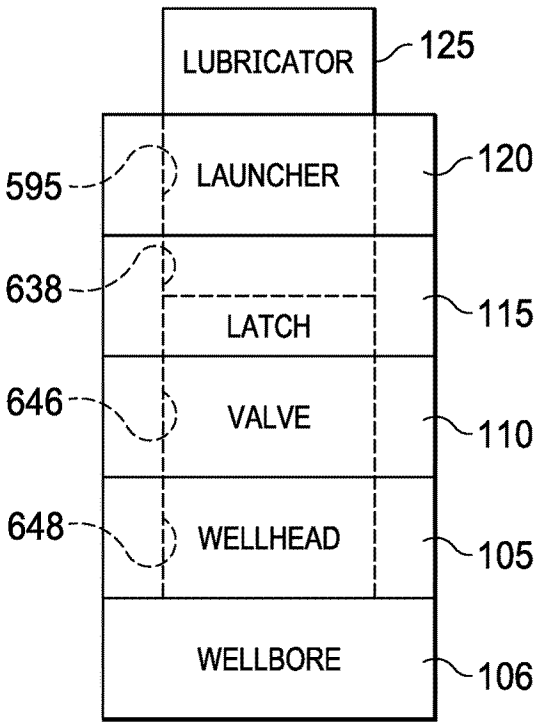
FIG. 8B is a diagrammatic illustration of the system of FIGS. 1 through 6C-3 in a second operational state or configuration during the execution of FIG. 7's method, according to one or more embodiments.
Figure 8A:
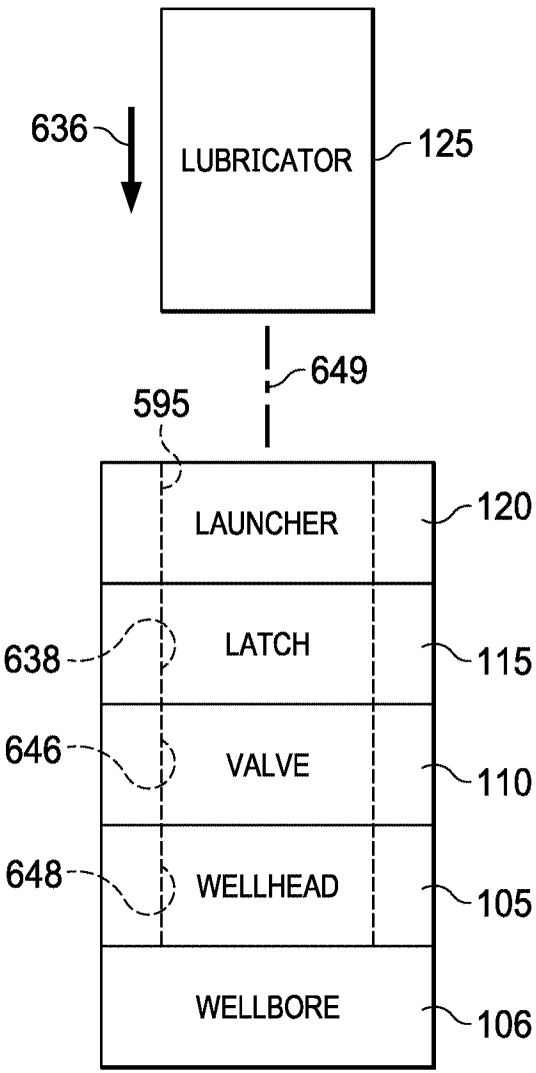
FIG. 8A is a diagrammatic illustration of the system of FIGS. 1 through 6C-3 in a first operational state or configuration during the execution of FIG. 7's method, according to one or more embodiments.

Referring to FIGS. 7 and 8A through 8C, with continuing reference to FIGS. 1 through 6C-3, in an embodiment, a method of launching an object (e.g., the ball 400*a*) into the wellbore 106 is generally referred to by the reference numeral 630. In several embodiments, the method 630 is executed using the system 100. In at least one such instance, the launcher 120 is connected to the latch 115 so that housing 180 of the kicker device 170 and the housing 415 of the actuator device 175 engage the latch 115, as shown in FIGS. 8A through 8C. Although not shown in FIGS. 8A through 8C, in several embodiments, a blowout preventer (BOP) may be operably coupled to the launcher 120, opposite the latch 115. The method 630 includes, at a step 635, extending the lubricator 125 through the central passageway 595 of the launcher 120. More particularly, the lubricator 125 is displaced in a direction 636 (shown in FIG. 8A), through the central passageway 595 of the launcher 120 (and the BOP attached thereto in certain embodiments), and into a central passageway 638 of the latch 115 (shown in FIG. 8B).

At a step 640, the lubricator 125 is attached to the latch 115. In several embodiments, the step 640 is executed after the step 635, and while the lubricator 125 extends through the central passageway 595 of the launcher 120. More particularly, the step 640 is executable when the lubricator 125 extends through the central passageway 595 of the launcher and into the central passageway 638 of the latch 115 (shown in FIG. 8B). In several embodiments, the latch 115, the central passageway 638, the lubricator 125, and the process of attaching the lubricator 125 to the latch 115 are described in the '623 Application, the '741 Application, or a combination thereof.

At a step 645, a first wellbore operation (e.g., a perforating operation) is performed while the lubricator 125 is attached to the latch 115. In several embodiments, the step 645 is executable by deploying a downhole tool (not shown; e.g., a plug and perforating guns) from the lubricator 125 while the lubricator 125 is attached to the latch 115. More particularly, the downhole tool passes through the central passageway 638 of the latch 115, through a central passageway 646 of the valve 110, through a central passageway 648 of the wellhead 105, and into the wellbore 106. In several embodiments, the valve 110, the central passageway 646, and the process of passing the downhole tool through the valve 110 and into the wellbore 106 are described in the '785 Application. In several embodiments, the central passageway 648 of the wellhead 105 extends along an axis 649. In such embodiments, the axis 610 about which the kicker 260 rotates (shown in FIGS. 6B-1 through 6C-3) has a non-perpendicular (e.g., parallel) relation with the axis 649 along which the central passageway 648 of the wellhead 105 extends. In those embodiments in which the downhole tool includes the plug and perforating guns, the plug is set, the perforating guns are fired, and the spent perforating guns are retrieved from the wellbore 106 and back into the lubricator 125 to complete execution of the step 645.

At a step 650, the lubricator 125 is detached from the latch 115. In several embodiments, the step 650 is executed after the first wellbore operation is performed at the step 645 (e.g., after the spent perforating guns are retrieved from the wellbore 106 and back into the lubricator 125). In several embodiments, the latch 115, the lubricator 125, and the process of detaching the lubricator 125 from the latch 115 are described in the '623 Application, the '741 Application, or a combination thereof.

At a step 655, the lubricator 125 is retracted from the central passageway 595 of the launcher 120. In several embodiments, the step 655 is executed after the step 650. More particularly, the lubricator 125 is displaced in a direction 656 (shown in FIG. 8C) to execute the step 655.

At a step 660, an object is launched from the launcher 120 into the central passageway 595 so that the object enters the wellbore 106. In several embodiments, the step 660 is executed after the step 655. The execution of the step 660 causes the object to pass through the valve 110 before entering the wellbore 106. In several embodiments, the valve 110 and the process of passing the object therethrough is described in the '785 Application. In several embodiments, the step 660 includes: rotating the cylinder 270 of the launcher 120 about the axis 610 between first and second angular positions, the cylinder 270 defining the chamber 300, as shown and described above in connection with FIGS. 6B-1 through 6B-3 (or in connection with FIGS. 6C-1 through 6C-3); loading the object (e.g., one of the balls 400*a-d*) into the chamber 300 when the cylinder 270 is in the first angular position, as shown and described above in connection with FIGS. 6A-1 through 6A-3; and launching the object from the chamber 300 when the cylinder 270 is in the second angular position, as shown and described above in connection with FIGS. 6B-1 through 6B-3. In several embodiments, the direction 615 in which the ball 400*a* is ejected (shown in FIGS. 6B-1 through 6B-3) has a non-parallel (e.g., perpendicular) relation with the axis 649 along which the central passageway 648 of the wellhead 105 extends.

Finally, at a step 665, a second wellbore operation (e.g., a hydraulic fracturing operation) is performed. In several embodiments, the step 665 is executed after the step 660. In those embodiments in which the second wellbore operation is a hydraulic fracturing operation, a hydraulic fracturing fluid is pumped into the wellbore 106 via the wellhead 105 to facilitate execution of the step 665.

Figure 9:
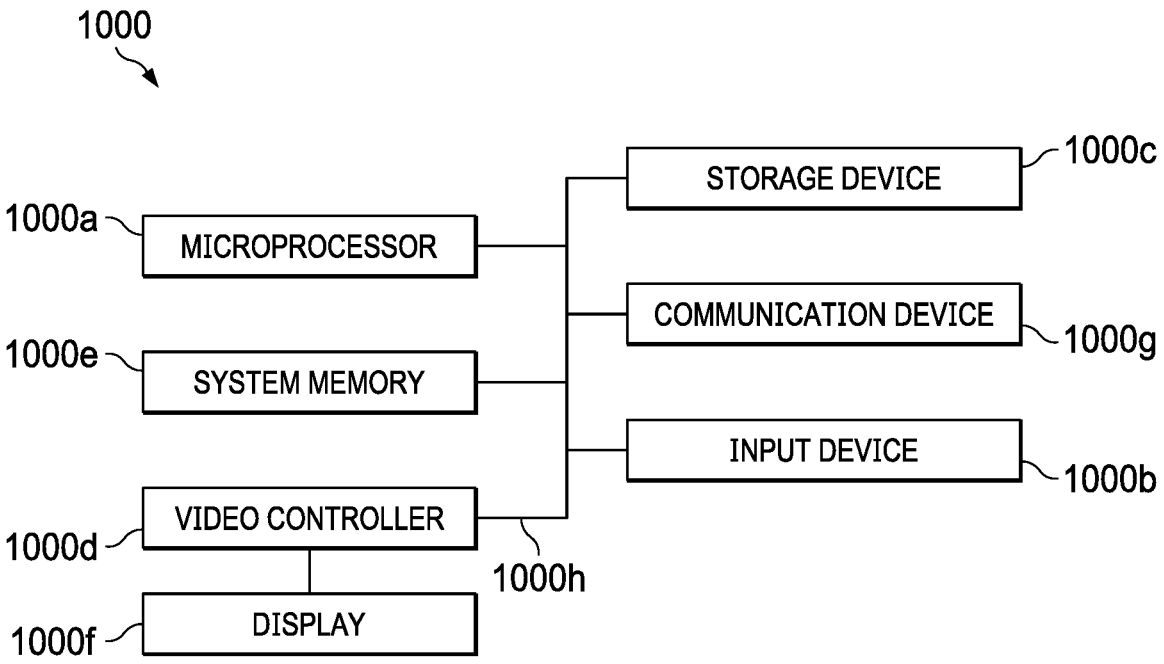
FIG. 9 is a diagrammatic illustration of a computing node for implementing one or more embodiments of the present disclosure.

Referring to FIG. 9, with continuing reference to FIGS. 1-53, in an embodiment, a computing node 1000 for implementing one or more embodiments of one or more of the above-described elements, systems, controllers, control units, methods, and/or steps, or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g*, all interconnected by one or more buses 1000*h*. In several embodiments, the microprocessor 1000*a* is, includes, or is part of, the control unit 130. In several embodiments, the storage device 1000*c* may include a floppy drive, hard drive, CD-ROM, optical drive, any other form of storage device or any combination thereof. In several embodiments, the storage device 1000*c* may include, and/or be capable of receiving, a floppy disk, CD-ROM, DVD-ROM, or any other form of computer-readable medium that may contain executable instructions. In several embodiments, the communication device 1000*g* may include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, combinations of hardware and software are also included within the definition of a computer system and are thus envisioned by the present disclosure as possible equivalent structures and equivalent methods.

In several embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, database may be any standard or proprietary database software. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a non-transitory computer readable medium may be executed by one or more processors to cause the one or more processors to carry out or implement in whole or in part the above-described operation of each of the above-described elements, systems (e.g.,), controllers (e.g.,), methods (e.g.,), and/or steps (e.g.,), or any combination thereof. In several embodiments, such a processor may include, or be a part of, one or more of the microprocessor 1000*a*, the control unit 130, any processor(s) that is/are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

A system has been disclosed. The system generally includes: a launcher adapted to be operably associated with a wellhead; wherein the launcher defines a first central passageway; wherein, when the launcher is operably associated with the wellhead, the launcher is adapted to launch an object into the first central passageway causing the object to pass through a second central passageway extending along a first axis and defined by the wellhead; wherein the launcher includes a cylinder rotatable about a second axis between first and second angular positions; wherein, when the launcher is operably associated with the wellhead, the second axis has a non-perpendicular relation with the first axis; wherein the cylinder defines a chamber: into which the object is adapted to be loaded when the cylinder is in the first angular position, and from which the object is adapted to be launched, in a first direction, when the cylinder is in the second angular position; and wherein, when the launcher is operably associated with the wellhead, the first direction has a non-parallel relation with the first axis. In several embodiments, the system further includes the object; wherein the object is adapted to be loaded into the chamber in a second direction when the cylinder is in the first angular position, the second direction being different from the first direction. In several embodiments, the system further includes the wellhead; wherein, when the launcher is operably associated with the wellhead, a downhole tool is deployable through the first and second central passageways and into a wellbore to perform a wellbore operation. In several embodiments, the system further includes: a latch adapted to be operably associated with the wellhead; and a lubricator, wherein the lubricator is extendable through the first central passageway of the launcher and, when so extended, attachable to the latch; wherein, when the latch is operably associated with the wellhead and the lubricator is attached to the latch, a downhole tool is deployable from the lubricator, through the second central passageway of the wellhead, and into a wellbore to perform a wellbore operation. In several embodiments, the launcher further includes: a follower movable to load the object into the chamber; and/or a foot movable to launch the object from the chamber. In several embodiments, the launcher further includes: a housing in which the cylinder is positioned, the housing defining at least a portion of the first central passageway. In several embodiments, the launcher further includes an actuator adapted to rotate the cylinder about the second axis between the first and second angular positions. In several embodiments, the launcher further includes a first housing in which the actuator is positioned, the first housing defining at least a portion of the first central passageway. In several embodiments, the launcher further includes a second housing in which the cylinder is positioned, the second housing defining at least another portion of the first central passageway.

A method has also been disclosed. The method generally includes: launching, using a launcher operably associated with a wellhead, an object into a first central passageway defined by the launcher causing the object to pass through a second central passageway extending along a first axis and defined by the wellhead; wherein launching the object includes: rotating a cylinder of the launcher about a second axis between first and second angular positions, the second axis having a non-perpendicular relation with the first axis; loading the object into a chamber defined by the cylinder when the cylinder is in the first angular position; and launching the object from the chamber, in a first direction, when the cylinder is in the second angular position, the first direction having a non-parallel relation with the first axis. In several embodiments, loading the object into the chamber includes: loading the object into the chamber in a second direction when the cylinder is in the first angular position, the second direction being different from the first direction. In several embodiments, the method further includes: deploying a downhole tool through the first and second central passageways and into a wellbore to perform a wellbore operation. In several embodiments, the method further includes: extending a lubricator through the first central passageway of the launcher; attaching the lubricator to a latch operably associated with the wellhead; and deploying a downhole tool from the lubricator, through the second central passageway of the wellhead, and into a wellbore to perform a wellbore operation. In several embodiments, loading the object into the chamber includes: moving a follower to load the object into the chamber; and/or launching the object from the chamber includes: moving a foot to launch the object from the chamber.

An apparatus has also been disclosed. The apparatus generally includes: a first housing adapted to be operably associated with a wellhead; and a cylinder disposed within the first housing and rotatable about a first axis between first and second angular positions; wherein the first housing at least partially defines a first central passageway; wherein, when the first housing is operably associated with the wellhead, the cylinder is adapted to launch an object into the first central passageway causing the object to pass through a second central passageway extending along a second axis and defined by the wellhead; wherein, when the first housing is operably associated with the wellhead, the first axis has a non-perpendicular relation with the second axis; wherein the cylinder defines a chamber: into which the object is adapted to be loaded when the cylinder is in the first angular position, and from which the object is adapted to be launched, in a first direction, when the cylinder is in the second angular position; and wherein, when the first housing is operably associated with the wellhead, the first direction has a non-parallel relation with the second axis. In several embodiments, the apparatus further includes the object; wherein the object is loadable into the chamber in a second direction when the cylinder is in the first angular position, the second direction being different from the first direction. In several embodiments, when the first housing is operably associated with the wellhead, a downhole tool is deployable through the first and second central passageways and into a wellbore to perform a wellbore operation. In several embodiments, the apparatus further includes: a follower movable to load the object into the chamber; and/or a foot movable to launch the object from the chamber. In several embodiments, the apparatus further includes: an actuator adapted to rotate the cylinder about the first axis between the first and second angular positions. In several embodiments, the apparatus further includes: a second housing in which the actuator is positioned, the second housing defining at least another portion of the first central passageway.

Another system has also been disclosed. The another system generally includes a latch adapted to be operably associated with a wellbore; a launcher adapted to be coupled to the latch, the launcher defining a central passageway and being adapted to launch an object into the central passageway so that the object enters the wellbore; and a lubricator, wherein the lubricator is: extendable through the central passageway of the launcher and, when so extended, attachable to the latch; and detachable from the latch and, when so detached, retractable from the central passageway of the launcher. In several embodiments, the launcher includes a cylinder rotatable about an axis between first and second angular positions, the cylinder defining a chamber into which the object is loadable when the cylinder is in the first angular position, and from which the loaded object is launchable when the cylinder is in the second angular position. In several embodiments, the launcher further includes: a follower movable to load the object into the chamber; and/or a foot movable to launch the object from the chamber. In several embodiments, the launcher includes the follower and the foot. In several embodiments, the launcher further includes a housing in which the cylinder is positioned, the housing defining at least a portion of the central passageway. In several embodiments, the launcher further includes an actuator adapted to rotate the cylinder about the axis between the first and second angular positions. In several embodiments, the launcher further includes a first housing in which the actuator is positioned, the first housing defining at least a portion of the central passageway. In several embodiments, the launcher further includes a second housing in which the cylinder is positioned, the second housing defining at least another portion of the central passageway.

Another method has also been disclosed. The another method generally includes extending a lubricator through a central passageway of a launcher; attaching the lubricator to a latch, the latch being operably associated with a wellbore; detaching the lubricator from the latch; retracting the lubricator from the central passageway of the launcher; and launching an object from the launcher into the central passageway so that the object enters the wellbore. In several embodiments, launching the object includes: rotating a cylinder of the launcher about an axis between first and second angular positions, the cylinder defining a chamber; loading the object into the chamber when the cylinder is in the first angular position; and launching the object from the chamber when the cylinder is in the second angular position. In several embodiments, loading the object into the chamber includes moving a follower to translate the object in a direction. In several embodiments, the direction is either transverse or skew to the axis. In several embodiments, launching the object from the chamber includes moving a foot to translate the object in a direction. In several embodiments, the direction is either transverse or skew to the axis.

Another apparatus has also been disclosed. The another apparatus generally includes: a cylinder rotatable about an axis between first and second angular positions, the cylinder defining a chamber into which the object is loadable when the cylinder is in the first angular position, and from which the loaded object is launchable when the cylinder is in the second angular position; wherein the another apparatus further includes: a follower movable to load the object into the chamber; and/or a foot movable to launch the object from the chamber. In several embodiments, the another apparatus includes the follower; wherein, to load the object into the chamber, the object is translatable in a first direction, the first direction being: either transverse or skew to the axis; and wherein the follower is movable to translate the object in the first direction. In several embodiments, the another apparatus includes the foot; wherein, to launch the object from the chamber, the object is translatable in a second direction, the second direction being: either transverse or skew to the axis; and wherein the foot is movable to translate the object in the second direction. In several embodiments, the another apparatus includes the follower and the foot. In several embodiments, the another apparatus defines a central passageway into which the object is adapted to pass when the object is launched from the chamber. In several embodiments, the another apparatus further includes a housing in which the cylinder is positioned, the housing defining at least a portion of the central passageway. In several embodiments, the another apparatus further includes: an actuator adapted to rotate the cylinder about the axis between the first and second angular positions. In several embodiments, the another apparatus defines a central passageway into which the object is adapted to pass when the object is launched from the chamber; and the another apparatus further includes a first housing in which the actuator is positioned, the first housing defining at least a portion of the central passageway. In several embodiments, the another apparatus further includes: a second housing in which the cylinder is positioned, the second housing defining at least another portion of the central passageway.

Yet another apparatus has also been disclosed. The yet another apparatus generally includes: a cylinder rotatable about an axis between first and second angular positions, the cylinder defining a chamber into which the object is loadable when the cylinder is in the first angular position, and from which the loaded object is launchable when the cylinder is in the second angular position; wherein, to load the object into the chamber, the object is translatable in a first direction, the first direction being: either transverse or skew to the axis; and wherein, to launch the object from the chamber, the object is translatable in a second direction, the second direction being: either transverse or skew to the axis; and either transverse or skew to the first direction. In several embodiments, the yet another apparatus further includes: a follower movable to load the object into the chamber by translating the object in the first direction; and/or a foot movable to launch the object from the chamber by translating the object in the second direction. In several embodiments, the yet another apparatus includes the follower and the foot. In several embodiments, the yet another apparatus defines a central passageway into which the object is adapted to pass when the object is launched from the chamber; and wherein the yet another apparatus further includes a housing in which the cylinder is positioned, the housing defining at least a portion of the central passageway. In several embodiments, the yet another apparatus further includes an actuator adapted to rotate the cylinder about the axis between the first and second angular positions. In several embodiments, the yet another apparatus defines a central passageway into which the object is adapted to pass when the object is launched from the chamber; and wherein the yet another apparatus further includes a first housing in which the actuator is positioned, the first housing defining at least a portion of the central passageway. In several embodiments, the yet another apparatus further includes: a second housing in which the cylinder is positioned, the second housing defining at least another portion of the central passageway.

Yet another method has also been disclosed. The yet another method generally includes: rotating a cylinder about an axis between first and second angular positions, the cylinder defining a chamber; loading the object into the chamber when the cylinder is in the first angular position, wherein loading the object into the chamber includes translating the object in a first direction, the first direction being: either transverse or skew to the axis; and launching the object from the chamber when the cylinder is in the second angular position, wherein launching the object from the chamber includes translating the object in a second direction, the second direction being: either transverse or skew to the axis; and either transverse or skew to the first direction. In several embodiments, loading the object into the chamber includes moving a follower to translate the object in the first direction. In several embodiments, launching the object from the chamber includes moving a foot to translate the object in the second direction. In several embodiments, launching the object from the chamber includes passing the object into a central passageway; and the cylinder is positioned within a housing, the housing defining at least a portion of the central passageway. In several embodiments, rotating the cylinder about the axis between the first and second angular positions includes moving the cylinder using an actuator. In several embodiments, launching the object from the chamber includes passing the object into a central passageway; and the actuator is positioned within a first housing, the first housing defining at least a portion of the central passageway. In several embodiments, the cylinder is positioned within a second housing, the second housing defining at least another portion of the central passageway.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-perpendicular relation with the first axis;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-parallel relation with the first axis;

wherein the system further comprises the object; and wherein the object is adapted to be loaded into the chamber in a second direction when the cylinder is in the first angular position, the second direction being different from the first direction.

2. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-perpendicular relation with the first axis;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-parallel relation with the first axis;

wherein the system further comprises the wellhead; and wherein, when the launcher is operably associated with the wellhead, a downhole tool is deployable through the first and second central passageways and into a wellbore to perform a wellbore operation.

3. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-perpendicular relation with the first axis;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-parallel relation with the first axis;

wherein the system further comprises:

a latch adapted to be operably associated with the wellhead; and a lubricator, wherein the lubricator is extendable through the first central passageway of the launcher and, when so extended, attachable to the latch;

and wherein, when the latch is operably associated with the wellhead and the lubricator is attached to the latch, a downhole tool is deployable from the lubricator, through the second central passageway of the wellhead, and into a wellbore to perform a wellbore operation.

4. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-perpendicular relation with the first axis;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-parallel relation with the first axis; and wherein the launcher further comprises:

a follower movable to load the object into the chamber; and/or a foot movable to launch the object from the chamber.

5. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-perpendicular relation with the first axis;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-parallel relation with the first axis;

wherein the launcher further comprises an actuator adapted to rotate the cylinder about the second axis between the first and second angular positions; and wherein the launcher further comprises a first housing in which the actuator is positioned, the first housing defining at least a portion of the first central passageway.

6. The system of claim 5, wherein the launcher further comprises a second housing in which the cylinder is positioned, the second housing defining at least another portion of the first central passageway.

7. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-perpendicular relation with the first axis;

loading the object into a chamber defined by the cylinder when the cylinder is in the first angular position; and launching the object from the chamber, in a first direction, when the cylinder is in the second angular position, the first direction having a non-parallel relation with the first axis;

and wherein loading the object into the chamber comprises:

loading the object into the chamber in a second direction when the cylinder is in the first angular position, the second direction being different from the first direction.

8. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-perpendicular relation with the first axis;

loading the object into a chamber defined by the cylinder when the cylinder is in the first angular position; and launching the object from the chamber, in a first direction, when the cylinder is in the second angular position, the first direction having a non-parallel relation with the first axis;

and wherein the method further comprises:

deploying a downhole tool through the first and second central passageways and into a wellbore to perform a wellbore operation.

9. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-perpendicular relation with the first axis;

loading the object into a chamber defined by the cylinder when the cylinder is in the first angular position; and launching the object from the chamber, in a first direction, when the cylinder is in the second angular position, the first direction having a non-parallel relation with the first axis;

and wherein the method further comprises:

extending a lubricator through the first central passageway of the launcher;

attaching the lubricator to a latch operably associated with the wellhead; and deploying a downhole tool from the lubricator, through the second central passageway of the wellhead, and into a wellbore to perform a wellbore operation.

10. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-perpendicular relation with the first axis;

loading the object into a chamber defined by the cylinder when the cylinder is in the first angular position; and launching the object from the chamber, in a first direction, when the cylinder is in the second angular position, the first direction having a non-parallel relation with the first axis;

and wherein:

loading the object into the chamber comprises moving a follower to load the object into the chamber; and/or launching the object from the chamber comprises moving a foot to launch the object from the chamber.

11. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-perpendicular relation with the second axis;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-parallel relation with the second axis;

wherein the apparatus further comprises the object; and wherein the object is loadable into the chamber in a second direction when the cylinder is in the first angular position, the second direction being different from the first direction.

12. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-perpendicular relation with the second axis;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-parallel relation with the second axis; and wherein, when the first housing is operably associated with the wellhead, a downhole tool is deployable through the first and second central passageways and into a wellbore to perform a wellbore operation.

13. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-perpendicular relation with the second axis;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-parallel relation with the second axis; and wherein the apparatus further comprises:

a follower movable to load the object into the chamber; and/or a foot movable to launch the object from the chamber.

14. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-perpendicular relation with the second axis;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-parallel relation with the second axis; and wherein the apparatus further comprises:

an actuator adapted to rotate the cylinder about the first axis between the first and second angular positions; and a second housing in which the actuator is positioned, the second housing defining at least another portion of the first central passageway.

15. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-vertical orientation;

wherein the system further comprises the object; and wherein the object is adapted to be loaded into the chamber in a second direction when the cylinder is in the first angular position, the second direction being different from the first direction.

16. The system of claim 15, wherein the launcher further comprises:

a housing in which the cylinder is positioned, the housing defining at least a portion of the first central passageway.

17. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-vertical orientation;

wherein the system further comprises the wellhead; and wherein, when the launcher is operably associated with the wellhead, a downhole tool is deployable through the first and second central passageways and into a wellbore to perform a wellbore operation.

18. The system of claim 17, wherein the launcher further comprises:

a housing in which the cylinder is positioned, the housing defining at least a portion of the first central passageway.

19. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-vertical orientation;

wherein the system further comprises:

a latch adapted to be operably associated with the wellhead; and a lubricator, wherein the lubricator is extendable through the first central passageway of the launcher and, when so extended, attachable to the latch;

and wherein, when the latch is operably associated with the wellhead and the lubricator is attached to the latch, a downhole tool is deployable from the lubricator, through the second central passageway of the wellhead, and into a wellbore to perform a wellbore operation.

20. The system of claim 19, wherein the launcher further comprises:

a housing in which the cylinder is positioned, the housing defining at least a portion of the first central passageway.

21. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-vertical orientation; and wherein the launcher further comprises:

a follower movable to load the object into the chamber; and/or a foot movable to launch the object from the chamber.

22. The system of claim 21, wherein the launcher further comprises:

a housing in which the cylinder is positioned, the housing defining at least a portion of the first central passageway.

23. A system, comprising:

a launcher adapted to be operably associated with a wellhead;

wherein the launcher defines a first central passageway;

wherein, when the launcher is operably associated with the wellhead, the launcher is adapted to launch an object into the first central passageway causing the object to pass through a second central passageway extending along a first axis and defined by the wellhead;

wherein the launcher comprises a cylinder rotatable about a second axis between first and second angular positions;

wherein, when the launcher is operably associated with the wellhead, the second axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the launcher is operably associated with the wellhead, the first direction has a non-vertical orientation;

wherein the launcher further comprises an actuator adapted to rotate the cylinder about the second axis between the first and second angular positions; and wherein the launcher further comprises a first housing in which the actuator is positioned, the first housing defining at least a portion of the first central passageway.

24. The system of claim 23, wherein the launcher further comprises a second housing in which the cylinder is positioned, the second housing defining at least another portion of the first central passageway.

25. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-horizontal orientation;

loading the object into a chamber defined by the cylinder when the cylinder is in the first angular position; and launching the object from the chamber, in a first direction, when the cylinder is in the second angular position, the first direction having a non-vertical orientation;

and wherein loading the object into the chamber comprises:

loading the object into the chamber in a second direction when the cylinder is in the first angular position, the second direction being different from the first direction.

26. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-horizontal orientation;

loading the object into a chamber defined by the cylinder when the cylinder is in the first angular position; and launching the object from the chamber, in a first direction, when the cylinder is in the second angular position, the first direction having a non-vertical orientation;

and wherein the method further comprises:

deploying a downhole tool through the first and second central passageways and into a wellbore to perform a wellbore operation.

27. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-horizontal orientation;

loading the object into a chamber defined by the cylinder when the cylinder is in the first angular position; and launching the object from the chamber, in a first direction, when the cylinder is in the second angular position, the first direction having a non-vertical orientation;

and wherein the method further comprises:

extending a lubricator through the first central passageway of the launcher;

attaching the lubricator to a latch operably associated with the wellhead; and deploying a downhole tool from the lubricator, through the second central passageway of the wellhead, and into a wellbore to perform a wellbore operation.

28. A method, comprising:

launching, using a launcher operably associated with a wellhead, an object into a first central passageway defined by the launcher causing the object to pass through a second central passageway extending along a first axis and defined by the wellhead;

wherein launching the object comprises:

rotating a cylinder of the launcher about a second axis between first and second angular positions, the second axis having a non-horizontal orientation;

loading the object into a chamber defined by the cylinder when the cylinder is in the first angular position; and launching the object from the chamber, in a first direction, when the cylinder is in the second angular position, the first direction having a non-vertical orientation;

and wherein:

loading the object into the chamber comprises moving a follower to load the object into the chamber; and/or launching the object from the chamber comprises moving a foot to launch the object from the chamber.

29. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-vertical orientation;

wherein the apparatus further comprises the object; and wherein the object is loadable into the chamber in a second direction when the cylinder is in the first angular position, the second direction being different from the first direction.

30. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-vertical orientation; and wherein, when the first housing is operably associated with the wellhead, a downhole tool is deployable through the first and second central passageways and into a wellbore to perform a wellbore operation.

31. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-vertical orientation; and wherein the apparatus further comprises:

a follower movable to load the object into the chamber; and/or a foot movable to launch the object from the chamber.

32. An apparatus, comprising:

a first housing adapted to be operably associated with a wellhead; and a cylinder disposed within the first housing and rotatable about a first axis between first and second angular positions;

wherein the first housing at least partially defines a first central passageway;

wherein, when the first housing is operably associated with the wellhead, the cylinder is adapted to launch an object into the first central passageway causing the object to pass through a second central passageway extending along a second axis and defined by the wellhead;

wherein, when the first housing is operably associated with the wellhead, the first axis has a non-horizontal orientation;

wherein the cylinder defines a chamber:

into which the object is adapted to be loaded when the cylinder is in the first angular position, and from which the object is adapted to be launched, in a first direction, when the cylinder is in the second angular position;

wherein, when the first housing is operably associated with the wellhead, the first direction has a non-vertical orientation;

wherein the apparatus further comprises:

an actuator adapted to rotate the cylinder about the first axis between the first and second angular positions; and wherein the apparatus further comprises:

a second housing in which the actuator is positioned, the second housing defining at least another portion of the first central passageway.

* * * * *